US008453864B2

(12) United States Patent
Krueger et al.

(10) Patent No.: US 8,453,864 B2
(45) Date of Patent: Jun. 4, 2013

(54) SPILL INHIBITORS FOR CONTAINERS

(76) Inventors: Brad D. Krueger, Millbrae, CA (US); Brett A. Krueger, Merrimack, NH (US); Katie L. Krueger, Merrimack, NH (US); Thomas A. Krueger, Warrenville, IL (US)

( * ) Notice: Subject to any disclaimer, the term of this patent is extended or adjusted under 35 U.S.C. 154(b) by 1100 days.

(21) Appl. No.: 12/023,165

(22) Filed: Jan. 31, 2008

(65) Prior Publication Data

US 2009/0194547 A1 Aug. 6, 2009

(51) Int. Cl.
*B65D 51/00* (2006.01)

(52) U.S. Cl.
USPC ..... 220/229; 220/370; 220/719

(58) Field of Classification Search
USPC ..... 220/229, 370, 371, 719; 15/104.92, 15/218.1, 220.4, 221
See application file for complete search history.

(56) References Cited

U.S. PATENT DOCUMENTS

| | | | | | |
|---|---|---|---|---|---|
| 1,134,881 | A | * | 4/1915 | Lockwood | 405/211 |
| 1,173,374 | A | * | 2/1916 | Nolda | 210/464 |
| 1,527,112 | A | * | 2/1925 | Blazer | 132/212 |
| 2,446,451 | A | * | 8/1948 | Allen | 215/11.1 |
| 2,753,050 | A | * | 7/1956 | Langston | 210/469 |
| 3,061,080 | A | * | 10/1962 | Stephen | 206/338 |
| 3,797,696 | A | | 3/1974 | Dibrell | |
| 4,328,904 | A | | 5/1982 | Iverson | |
| 4,483,455 | A | | 11/1984 | Prophet, Jr. et al. | |
| 4,884,717 | A | | 12/1989 | Bussard et al. | |
| 4,944,423 | A | | 7/1990 | Clark et al. | |
| 5,404,610 | A | * | 4/1995 | Coyer | 15/104.92 |
| 5,471,706 | A | * | 12/1995 | Wallock et al. | 15/302 |
| 5,652,993 | A | * | 8/1997 | Kreyer | 15/104.92 |
| 5,752,604 | A | * | 5/1998 | Hayman | 206/534 |
| 6,176,384 | B1 | | 1/2001 | Voloshin | |
| 6,273,309 | B1 | | 8/2001 | Oppelt | |
| 6,656,514 | B1 | | 12/2003 | Tubbs | |
| 7,162,766 | B1 | * | 1/2007 | Yakopcic | 15/104.92 |
| 2002/0139799 | A1 | * | 10/2002 | Karaki et al. | 220/229 |
| 2003/0062366 | A1 | | 4/2003 | Moss | |
| 2005/0252923 | A1 | | 11/2005 | Woolf | |
| 2005/0263523 | A1 | | 12/2005 | Moss | |
| 2007/0012701 | A1 | | 1/2007 | Amormino | |
| 2007/0062942 | A1 | | 3/2007 | Samson et al. | |
| 2007/0272695 | A1 | | 11/2007 | Shepard | |
| 2008/0078762 | A1 | * | 4/2008 | Iyer | 220/229 |
| 2008/0099488 | A1 | * | 5/2008 | Dahlquist et al. | 220/560.03 |

OTHER PUBLICATIONS

'Microscopy of Hair Part II: A Practical Guide and Manual for Animal Hairs.' Douglas Deedrick and Sandra Koch. Forensic Science Communications. Jul. 2004—vol. 6—No. 3.*

(Continued)

*Primary Examiner* — Anthony Stashick
*Assistant Examiner* — James N Smalley
(74) *Attorney, Agent, or Firm* — Honigman Miller Schwartz and Cohn LLP

(57) ABSTRACT

A spill inhibitor for a container includes a spill inhibitor body configured to be releasably secured to or integral with a container. The spill inhibitor body defines an opening therethrough and has a plurality of compliant finger projections extending from the spill inhibitor body. The finger projections are arranged to impede movement of an item through the opening of the spill inhibitor body for controlling passage of the item through a mouth of the container.

51 Claims, 21 Drawing Sheets

OTHER PUBLICATIONS

Definition of the word "bristle" from http://www.dictionary.com.*
Kodak Rubber: 'Durometer Hardness Conversion Table', http://www.kodiakrubber.com/files/Microsoft_Word_-—_Durometer_Hardness_Conversion_Table.pdf. Sep. 23, 2009.*
Machinist-Materials: 'Hardness Measurement and Specifications', http://www.machinist-materials.com/hardness.htm. Sep. 23, 2009.*
Rex Gauge Company: 'Comparison Chart', http://www.rexgauge.com/content/tech_comparison_chart. Sep. 23, 2009.*
International Search Report dated May 15, 2009, in connection with International application No. PCT/US2009/030528, 18 pages.
International Preliminary Report on Patentability for Application PCT/US2009/030528 dated May 11, 2010.

* cited by examiner

SPILL INHIBITORS FOR CONTAINERS

TECHNICAL FIELD

This disclosure relates to spill inhibitors for containers.

BACKGROUND

Many types of containers and closures are employed to store and/or hold items. For example, a cylindrical container with a screw-on or snap-on lid has been widely used to store a variety of items. However, these screw-on and snap-on container closures exhibit a significant disadvantage. When the container is opened to gain access to the contents thereof, there is an exposure of the contents to spillage through the open aperture created by removal of the closure. While this problem may be considered only an inconvenience by adults, the problem is a significant one when the container is primarily intended for use by small children or while playing sports or exercising.

SUMMARY

The present disclosure provides a spill inhibitor system for a container (e.g. bowls or cups) and/or bag that prevents or impedes items stored inside the container or bag from unwantedly exiting the container or bag. The spill inhibitor system may be implemented for a snack container. The spill inhibitor system prevents or impedes a dry, granular food item stored inside the container or bag from unwantedly exiting until the item is actively removed by hand by pulling the item past the spill inhibitor system. The spill inhibitor system may be implemented for a climbing chalk container or bag. The spill inhibitor system prevents or impedes chalk stored inside the container or bag from unwantedly exiting until a user actively inserts a hand or object into the container or bag and pulls chalk past the spill inhibitor system. The spill inhibitor system may be implemented for a multi-use container or bag to hold items of any solid nature. The spill inhibitor system may prevent or impede paper-clips, binder clips, screws, nails, washers, bolts, nuts, or any other solid item stored inside the container or bag from unwantedly exiting the container or bag until a user actively inserts a hand or object into the container or bag and pulls it past the spill inhibitor system.

In one aspect, a spill inhibitor for a container includes a spill inhibitor body configured to be releasably secured to the container. The spill inhibitor body defines an opening therethrough and has a plurality of compliant finger projections extending from the spill inhibitor body. The finger projections are arranged to impede movement of an item through the opening of the spill inhibitor body (e.g. for controlling passage of the item through a mouth of the container).

Implementations of this aspect of the disclosure may include one or more of the following features. In some implementations, the spill inhibitor body is configured as an insert to be received in the mouth of the container. The spill inhibitor body defines a lip configured to be received against a rim of the mouth of the container and hold the spill inhibitor body at the mouth of the container.

In some implementations, the spill inhibitor body defines threads configured to mate with corresponding threads defined by the container. In other implementations, the spill inhibitor body defines an engagement portion configured to engage and couple the spill inhibitor body to the mouth of the container. In some examples, the spill inhibitor includes at least one fastener system disposed on the spill inhibitor body that is configured to releasably secure the spill inhibitor to the container. The fastener system may include a clip or clamp, a hook and loop fastener system, snaps, or buttons disposed for releasably fastening the spill inhibitor to the container. More examples include a snap-fit, magnet, zipper, strap and buckle, and/or adhesive connection between the spill inhibitor and the container.

In another aspect, a spill inhibitor system for a bag includes a spill inhibitor and a retaining device. The spill inhibitor includes a spill inhibitor body defining an opening therethrough, and has a plurality of compliant finger projections extending from the spill inhibitor body. The finger projections are arranged to impede movement of an item through the opening. The retaining device releasably secures the spill inhibitor to at least a portion of the bag.

Implementations of this aspect of the disclosure may include one or more of the following features. In some implementations, the retaining device defines threads configured to mate with corresponding threads defined by the spill inhibitor body. At least a portion of the bag is held between the spill inhibitor body and the mating retaining device. In other implementations, the retaining device is a threaded band (e.g. hose clamp) or a an elastic band sized to fit around a perimeter of the spill inhibitor body. At least a portion of the bag is held between the spill inhibitor body and the band received over the spill inhibitor body. The retaining device, in some implementations, is magnetically secured to the spill inhibitor body with at least a portion of the bag being held therebetween. In some implementations, the retaining device defines an engagement portion configured to engage and couple the retaining device to the spill inhibitor body with at least a portion of the bag being held therebetween.

Implementations of the previous two aspects of the disclosure may include one or more of the following features. In some implementations, each finger projection has a proximal end joined to the spill inhibitor body and a free distal end. The proximal end of at least one finger projection has an overall height greater than about 10% of an overall width measured perpendicular to the height. In some examples, the finger projections extend radially inwardly toward a longitudinal axis defined by the spill inhibitor body, such that the finger projections substantially provide a closure of the opening. The distal ends of the finger projections are positioned substantially in proximity with the longitudinal axis. In other examples, the finger projections extend inwardly toward and substantially normal to a longitudinal plane defined by the spill inhibitor body, such that the finger projections substantially provide a closure of the opening. The distal ends of the finger projections are positioned substantially in proximity with the longitudinal plane. The finger projections may be arranged substantially co-planar in at least two layers spaced from each other along a longitudinal axis defined by the spill inhibitor body. Each finger projection layer is offset from an adjacent finger projection layer by a predetermined arc of rotation about the longitudinal axis. In some implementations, the finger projections extend from a surface of the opening. At least one of the finger projections may define a substantially cylindrical shape or a polyhedron shape. At least one of the finger projections, in some examples, tapers in cross-sectional shape from a proximal end joined to the spill inhibitor body to a free distal end. In some examples, the spill inhibitor includes a cover removably securable to the container body (e.g. covering the mouth of the container or stored on a bottom side of the container body) and/or the spill inhibitor.

In yet another aspect, a spill inhibiting container includes a container body defining a receptacle having a mouth. A plurality of compliant finger projections extend from a surface of the receptacle and are arranged to impede movement of an item through the mouth.

Implementations of this aspect of the disclosure may include one or more of the following features. In some implementations, each finger projection has a proximal end joined to the container body and a free distal end. The proximal end of at least one finger projection has an overall height greater than about 10% of an overall width measured perpendicular to the height. In some examples, the finger projections extend radially inwardly toward a longitudinal axis defined by the container body, such that the finger projections substantially provide a closure of the opening. The distal ends of the finger projections are positioned substantially in proximity with the longitudinal axis. In other examples, the finger projections extend inwardly toward and substantially normal to a longitudinal plane defined by the container body, such that the finger projections substantially provide a closure of the opening. The distal ends of the finger projections are positioned substantially in proximity with the longitudinal plane. The finger projections may be arranged substantially co-planar in at least two layers spaced from each other along a longitudinal axis defined by the container body. Each finger projection layer is offset from an adjacent finger projection layer by a predetermined arc of rotation about the longitudinal axis. In some implementations, the finger projections extend from a surface of the receptacle. At least one of the finger projections may define a substantially cylindrical shape or a polyhedron shape. At least one of the finger projections, in some examples, tapers in cross-sectional shape from a proximal end joined to the container body to a free distal end. In some examples, the spill inhibiting container includes a cover removably secured to the container body, covering the mouth of the container.

The details of one or more implementations of the disclosure are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Figure 1:
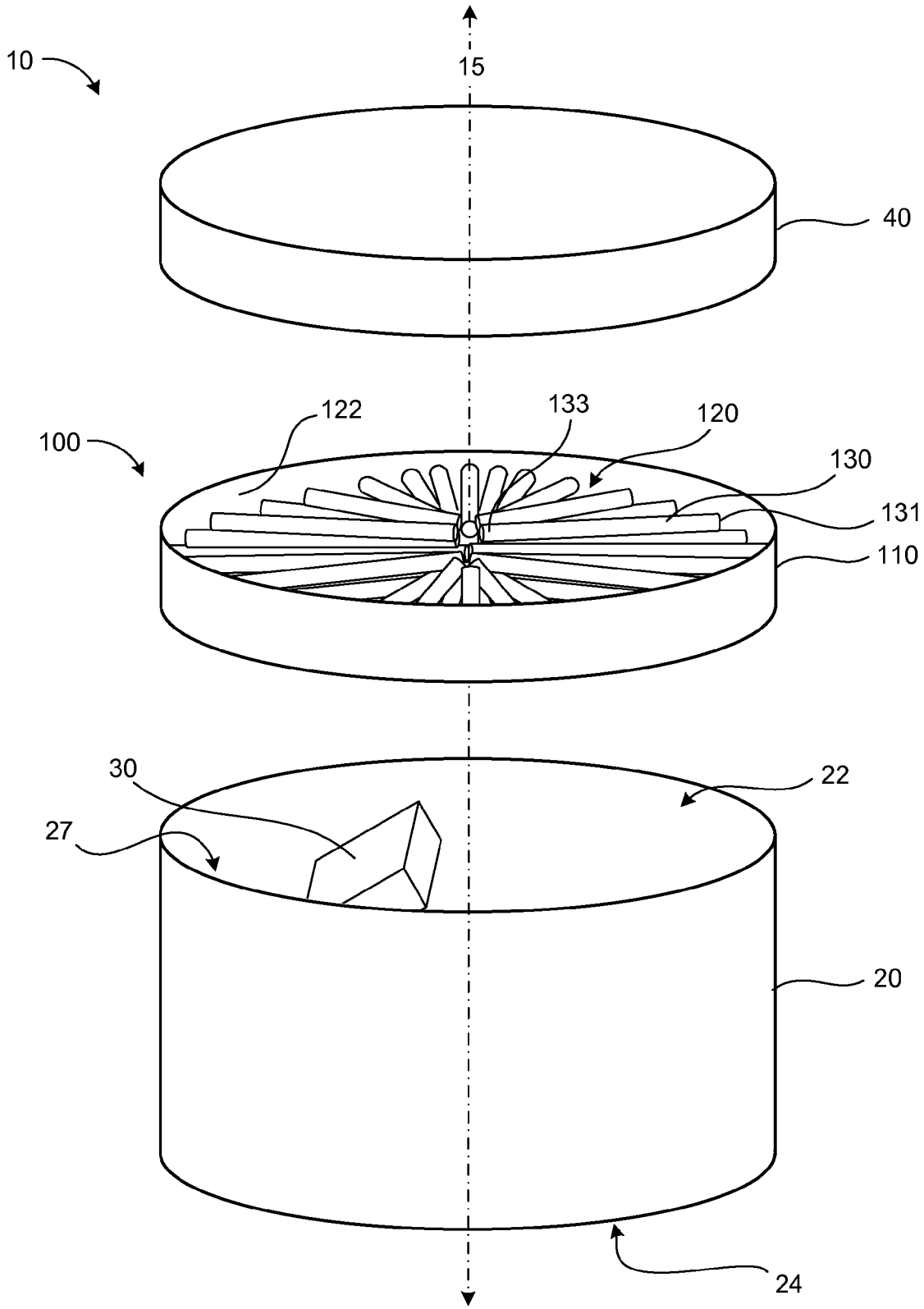
FIG. 1 is a perspective view of a spill inhibiting container system that includes a lid, a spill inhibitor, and a container.

Referring to FIG. 1, in some implementations, a spill inhibiting container system 10 includes a container 20 and a spill inhibitor 100 for controlling passage of an item 30 through a mouth 22 of the container 20, and therefore into or out of a receptacle 27 defined by the container 20. The mouth 22 of the container 20 is an opening through which the container 20 may be filled or emptied. The spill inhibitor 100 includes a spill inhibitor body 110 configured for association with the mouth 22 of the container 20. The spill inhibitor body 110 may be integral with the container 20, as will be described later, or configured to be releasably secured to the container 20, as will be described now. The spill inhibitor body 110 defines an opening 120 therethrough. A plurality of compliant finger projections 130 extend from the spill inhibitor body 110 and are arranged to impede an item 30 from passing through the opening 120. In some examples, the finger projections 130 extend from a surface 122 of the opening 120. Each finger projection 130 has a proximal end 131 joined to the spill inhibitor body 110 and a free distal end 133.

In some implementations, the spill inhibiting container system 10 includes a cover 40 configured to be releasably secured to the spill inhibitor 100 and/or the container 20 (e.g. to the mouth 22 and/or the bottom 24 of the container 20). The cover 40 is releasably secured by a snap-fit, interference-fit, threaded connection, magnetic connection, and/or friction-fit with the spill inhibitor 100 and/or the container 20. Other suitable means of connection may be used as well. The cover 40 is used to seal (e.g. air tight) the opening 120 of the spill inhibitor body 110 and/or the mouth 22 of the container 20 (e.g. to maintain freshness of contents in the container 20 or to prevent escape of contents or portions thereof in the container 20 during transport).

The container 20 may be made of any suitable material, such as rubber, plastic, aluminum, latex, silicone, or other suitable material. In some examples, the container 20 is made of high-density polyethylene (HDPE), which is a polyethylene thermoplastic that is sturdy, reliable, and economical. HDPE is dishwasher safe (e.g. top rack only) and withstands temperatures from about −100° C. (−148° F.) to about 120° C. (248° F.).

The spill inhibitor body 110 and the finger projections 130 are formed as one integral piece to form the spill inhibitor 100, in some examples, and as separate components joined together in other examples. The finger projections 130 may be made of rubber, latex, plastic, silicone, or other suitable material. In some examples, the finger projections 130 have a durometer of between about 30 Shore (A-scale) and about 60 Shore (A-scale).

Figure 2:
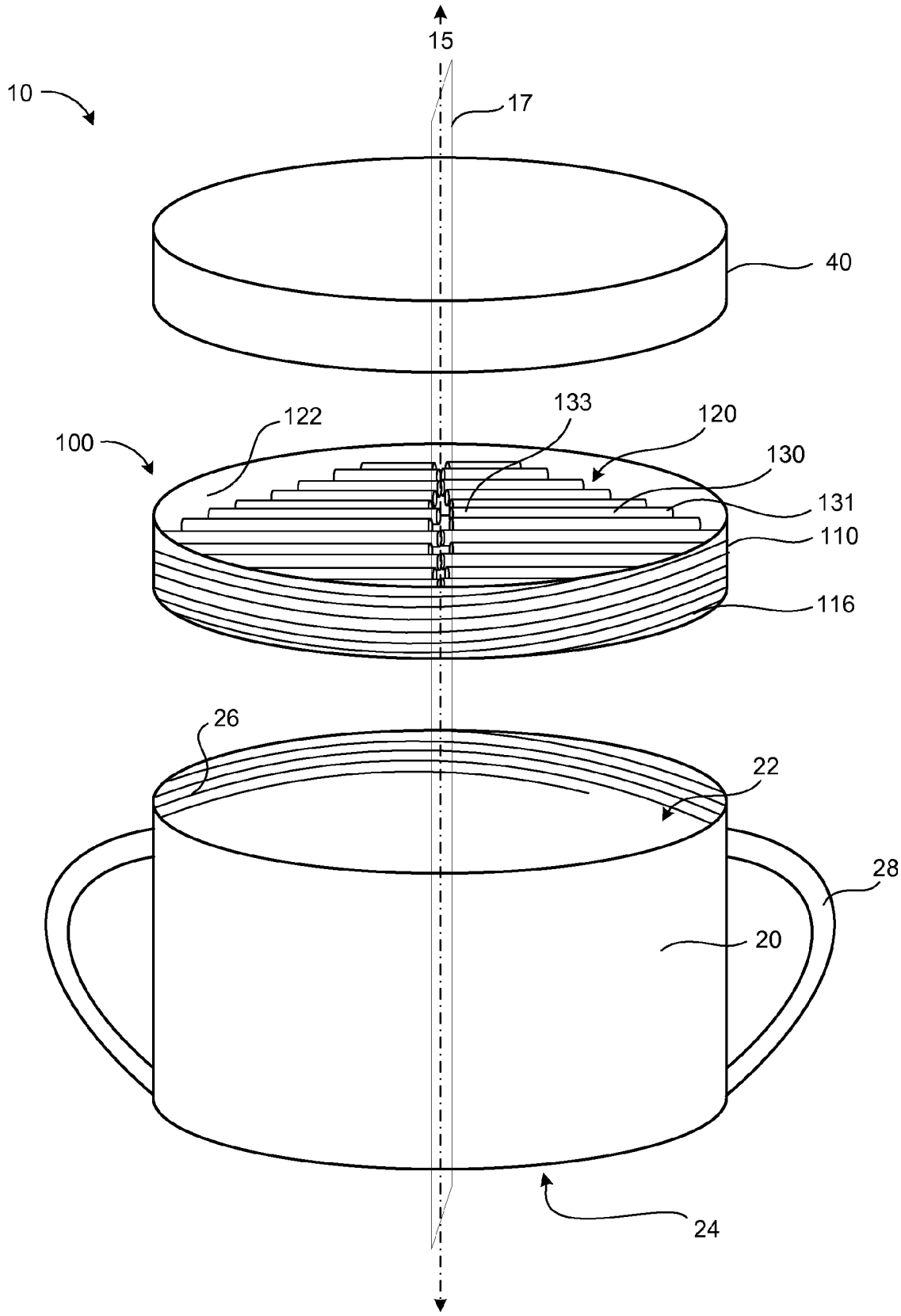
FIG. 2 is a perspective view of a spill inhibitor that threads into the mouth of a container and has finger projections which extend inwardly toward and substantially normal to a longitudinal plane defined by the spill inhibitor.
Figure 3:
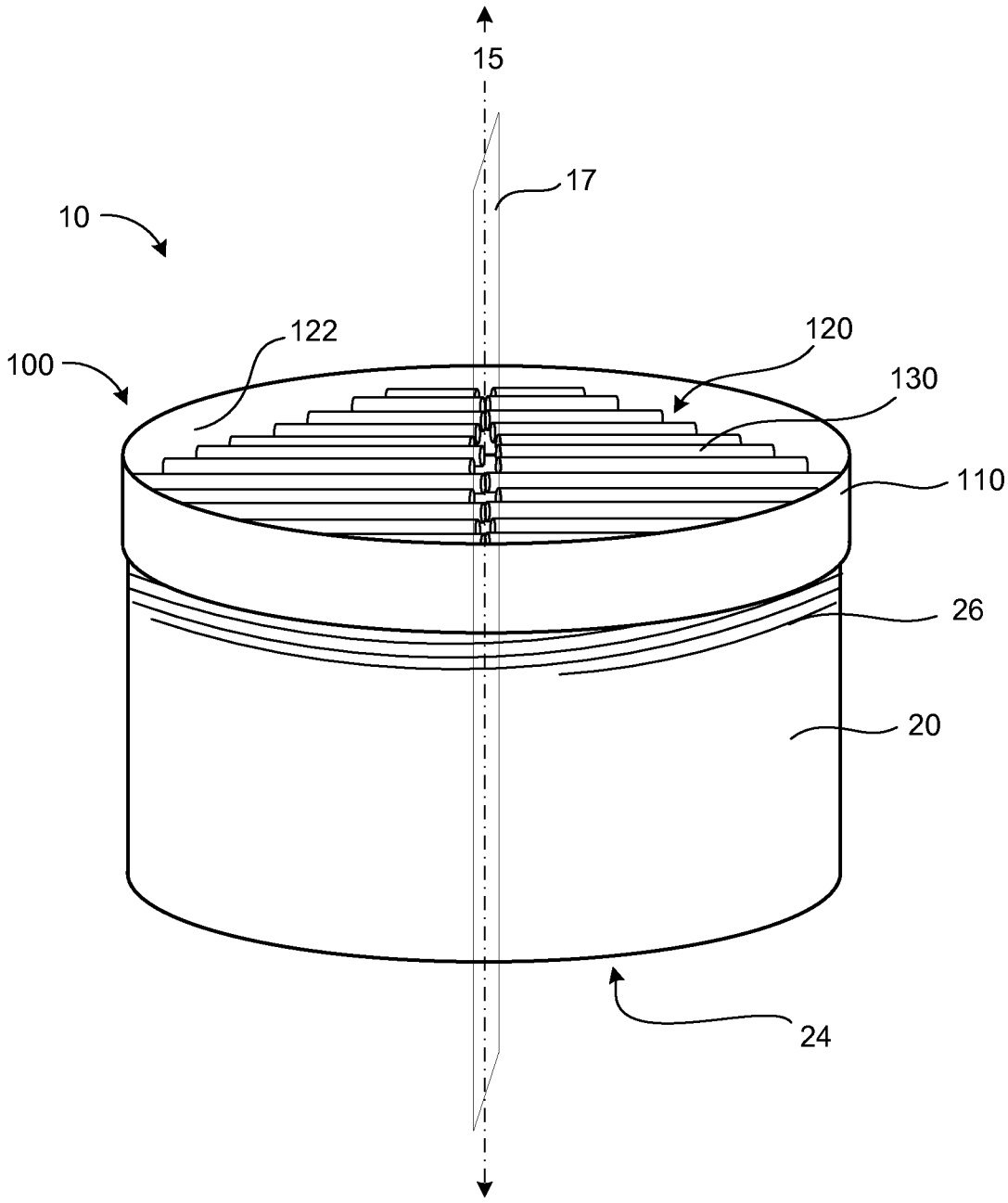
FIG. 3 is a perspective view of a spill inhibitor that threads onto a container.

In the example illustrated in FIG. 2, the spill inhibitor body 110 is configured to be received by the mouth 22 of the container 20. The spill inhibitor body 110 defines threads 116 configured to mate with corresponding threads 26 defined by the container 20. The threads 26, 116 are defined, in some examples, so that the spill inhibitor body 110 is received inside the mouth 22 of the container 20, as shown. In other examples, the threads 26, 116 are defined so that the spill inhibitor body 110 is received over the mouth 22 and over the container 20, as shown in FIG. 3. The spill inhibitor body 110 may include one or more handles 28 (see FIG. 2), which aid manipulation of the container 20 by a user. The handle 28 may be configured to receive a clip or carabineer for attaching the container 20 to another object.

In some implementations, the finger projections 130 extend radially inwardly (e.g. from the opening surface 122) toward a longitudinal axis 15 defined by the spill inhibitor body 110, as shown in FIG. 1, such that the finger projections 130 substantially provide a closure of the opening 120. The distal ends 133 of the finger projections 130 may be positioned substantially in proximity with the longitudinal axis 15, past the longitudinal axis 15, or short of the longitudinal axis 15. In other implementations, the finger projections 130 extend inwardly (e.g. from the opening surface 122) toward and substantially normal to a longitudinal plane 17 defined by the spill inhibitor body 110, as shown in FIG. 2, such that the finger projections 130 substantially provide a closure of the opening 120. The distal ends 133 of the finger projections 130 may be positioned substantially in proximity with the longitudinal plane, past the longitudinal axis 15, or short of the longitudinal axis 15.

Figure 4:
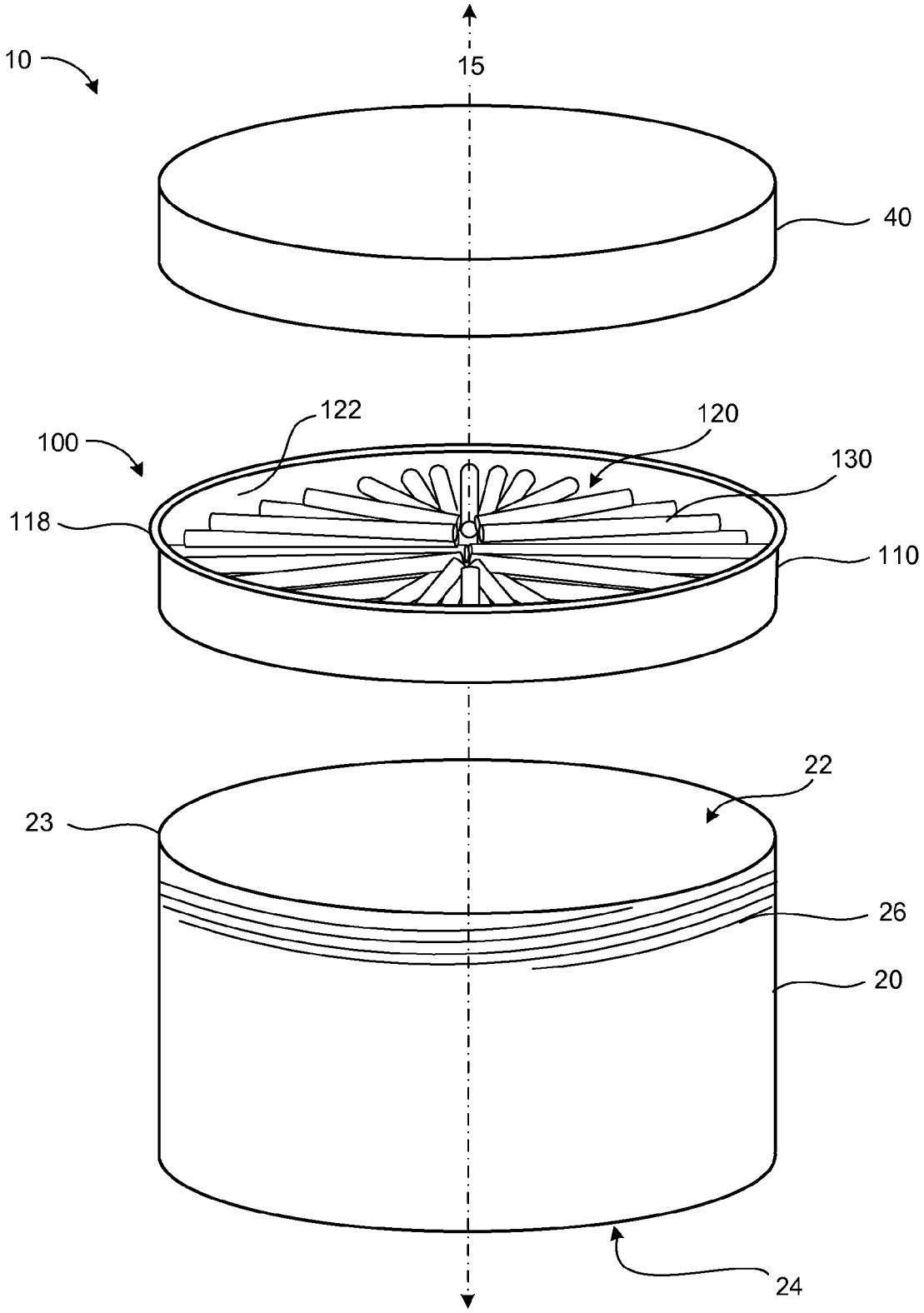
FIG. 4 is a perspective view of a spill inhibitor that slides into the mouth of a container.

Referring to FIG. 4, in some implementations, the spill inhibitor body 110 is configured for insertion by sliding into the mouth 22 of the container 20. The spill inhibitor body 110 may be sized for an interference fit with the container mouth 22. In the example shown, the spill inhibitor body 110 defines a lip 118 configured to be received against a rim 23 of the mouth 22 of the container 20 and hold the spill inhibitor body 110 at the mouth 22 of the container 20 (e.g. from falling past the rim 23 into the container 20). However, in other examples, the lip 118 is omitted and the spill inhibitor body 110 remains in place by friction. In examples including the cover 40, the cover 40 attaches to the container 20. This implementation is advantageous for existing containers, such that a user can place the insert type spill inhibitor 100 into the mouth of an existing container, while not impeding usage of an associated cover. In camping applications, the insert type spill inhibitor 100 can be inserted into a container attached or affixed to a back pack while hiking to avoid spills, and removed while sitting. However, in other examples, the cover 40 may be attached to the inhibitor body 110.

Figure 5A:
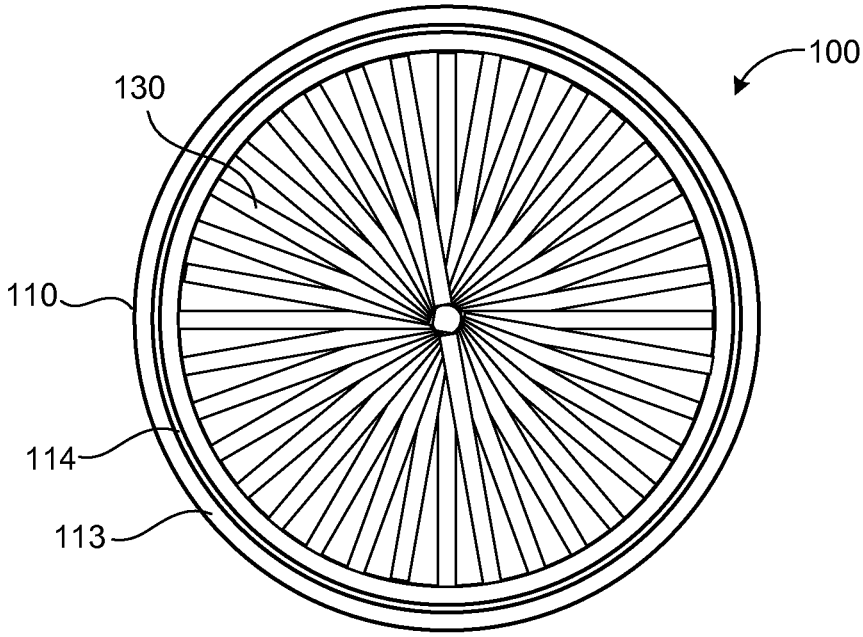
FIG. 5A is a bottom view of a spill inhibitor defining a recess in its rim for receiving and connecting to a mating rim of a container.
Figure 5B:
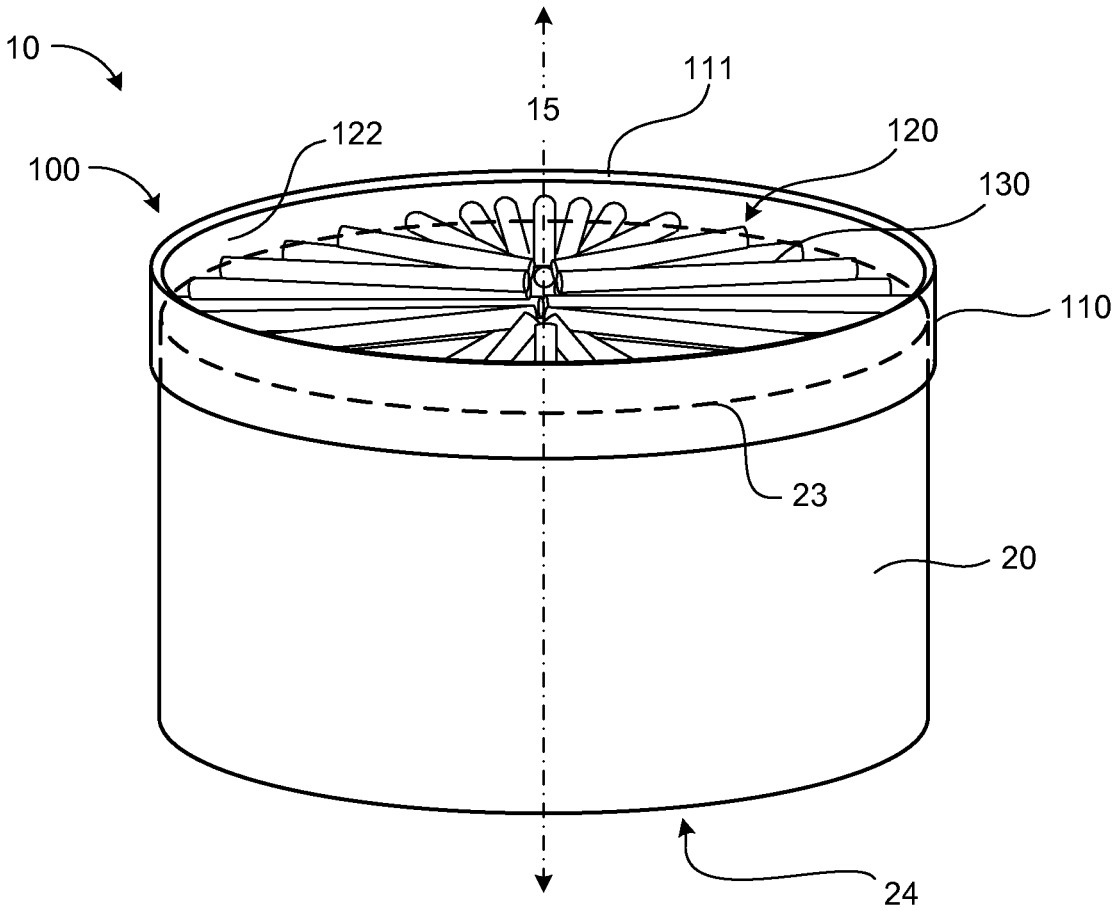
FIG. 5B is a perspective view of the spill inhibitor in FIG. 5A attached to the container.

In the example illustrated in FIGS. 5A-5B, the spill inhibitor body 110 defines a recess 114 along its bottom rim 113. The recess 114 is configured to receive and attach to a rim 23 at the mouth 22 (e.g. see FIG. 4) of the container 20. The recess 114 may attach to the container rim 24 by a snap-fit, interference fit, magnetic connection, adhesive, fasteners, and/or friction fit. In some examples, the cover 40 defines a recess as well configured to receive and attach to an upper rim 111 of the spill inhibitor body 110. The example shown illustrates a circular configuration; however, other shapes (e.g. polygons) work equally as well.

Figure 6:
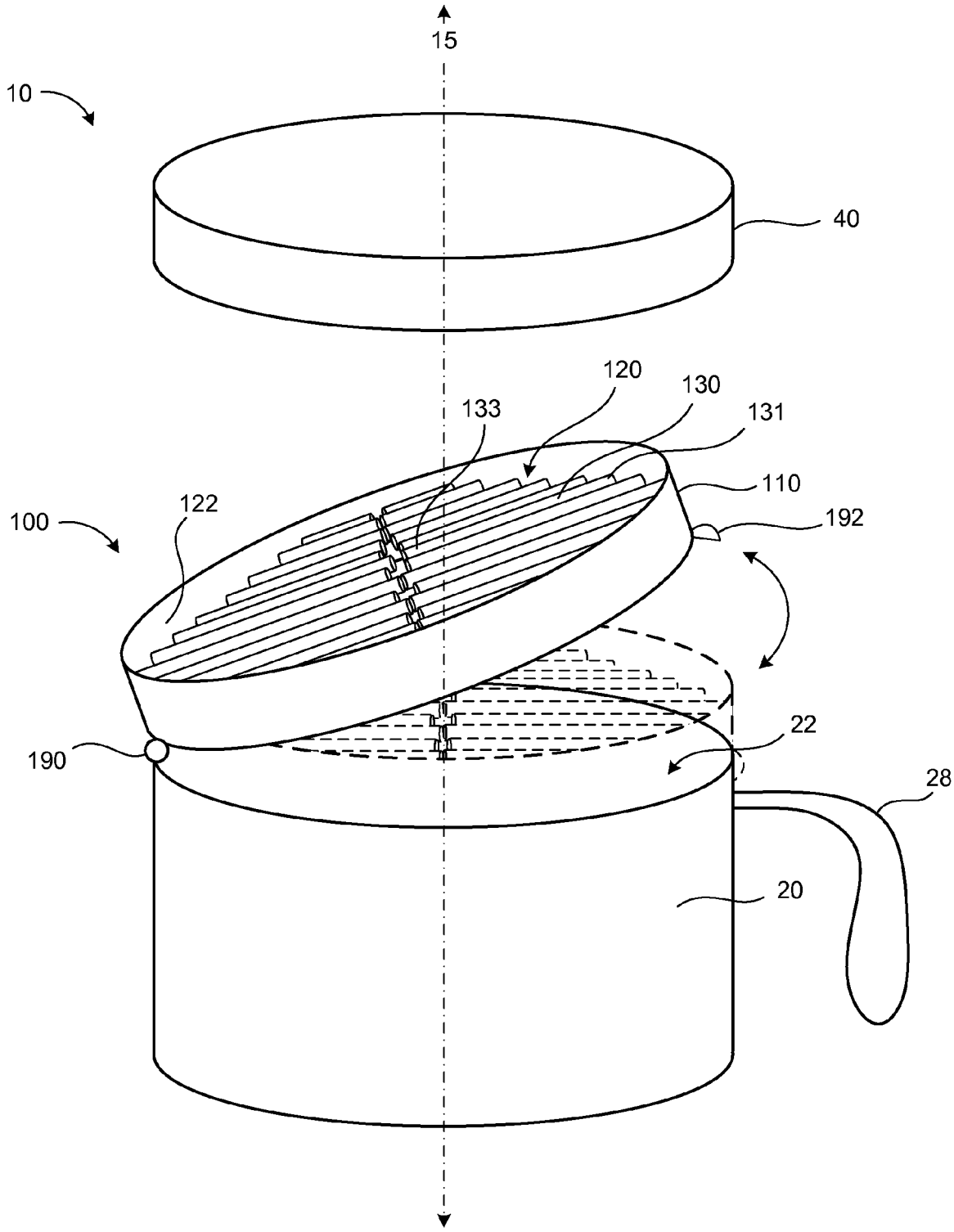
FIG. 6 is a perspective view of a spill inhibitor pivotally attached to a container.

In the example of the spill inhibiting container system 10 illustrated in FIG. 6, the spill inhibitor 100 is pivotally attached to the container 20. The spill inhibitor body 110 is shown attached to the container 20 by a hinge 190, allowing the spill inhibitor 100 to rotate between an open position, providing access into the container 20, and a closed position engaged with the mouth 22 of the container 20. The spill inhibitor 100 and/or container 20 may include a fastener 192 (e.g. clip or clamp, hook and loop fasteners, magnet, etc.) for holding the spill inhibitor 100 in the closed position, by releasably securing the spill inhibitor body 110 to the container 20, thereby preventing rotation of the spill inhibitor 100. As noted above, the cover 40 releasably secures to the spill inhibitor 100 and/or the container 20.

Figure 7:
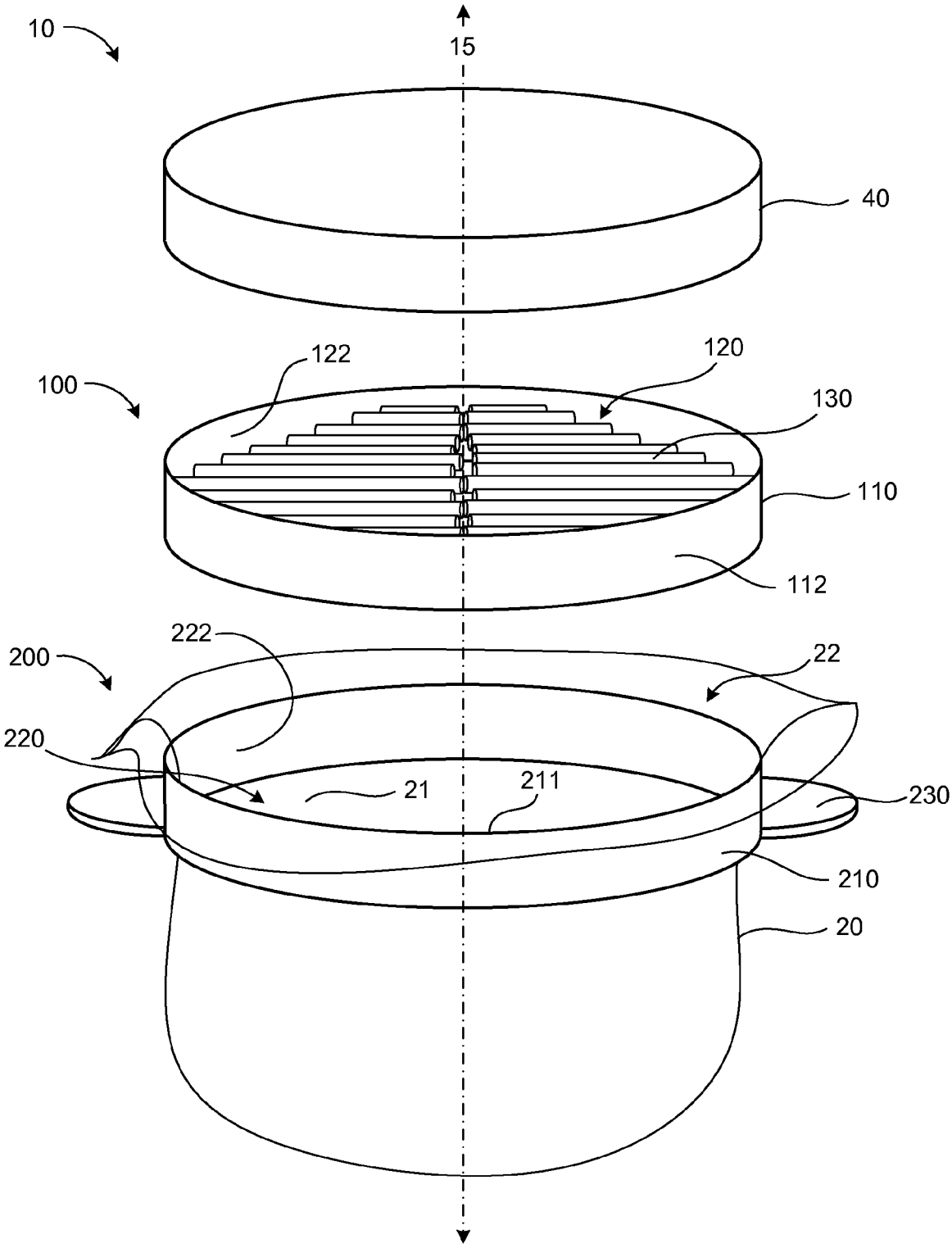
FIG. 7 is a perspective view of a spill inhibiting container system that includes a lid, a spill inhibitor, and a retaining device that secures a container to the spill inhibitor.

Referring to FIG. 7, in some implementations, the spill inhibiting container system 10 includes a retaining device 200 that releasably secures the spill inhibitor body 110 to the container 20 (e.g. at the mouth 22 of the container 20). At least one wall 21 of the container 20 is held between the spill inhibitor body 110 and the retaining device 200. In the example shown, the container 20 is a plastic or cloth bag. The retaining device 200 has a retaining device body 210 that defines an opening 220, which has an inner wall 222. The spill inhibitor 100 is placed in the mouth 22 of the bag-type container 20, and the retaining device 200 is placed over the bag-type container 20. The inner wall 222 of the retaining device body opening 220 secures at least one wall 21 of the container 20 to an outer wall 112 of the spill inhibitor body 110. In other examples, the spill inhibitor body 110 is received over and substantially around the retaining device 200, while trapping at least a portion of the bag-type container 20 in between. FIG. 7 illustrates an example of the spill inhibitor body 110 configured to slide into the opening 220 of the retaining device 200. The spill inhibitor body 110 and/or the retaining device body opening 220 may be tapered to cause an interference fit and/or friction fit between the two. The retaining device 200 may be secured to the spill inhibitor body 110 by an interference fit, friction fit, snap connection, magnetic connection, and/or threaded connection, among other examples. For a magnetic connection, magnets are embedded in or secured to the spill inhibitor body 110 and/or the retaining device body 200, while the mating component 110, 200 is optionally made of a magnetically attractable material.

As previously described with reference to FIG. 5A, the spill inhibitor body 110, in some examples, defines a recess 114 along its bottom rim 113. The recess 114 receives and attaches to a rim 211 of the retaining device body 200, while trapping the bag-type container 20 in between, thus securing the spill inhibitor 100 to the mouth of the bag-type container 20.

Figure 8:
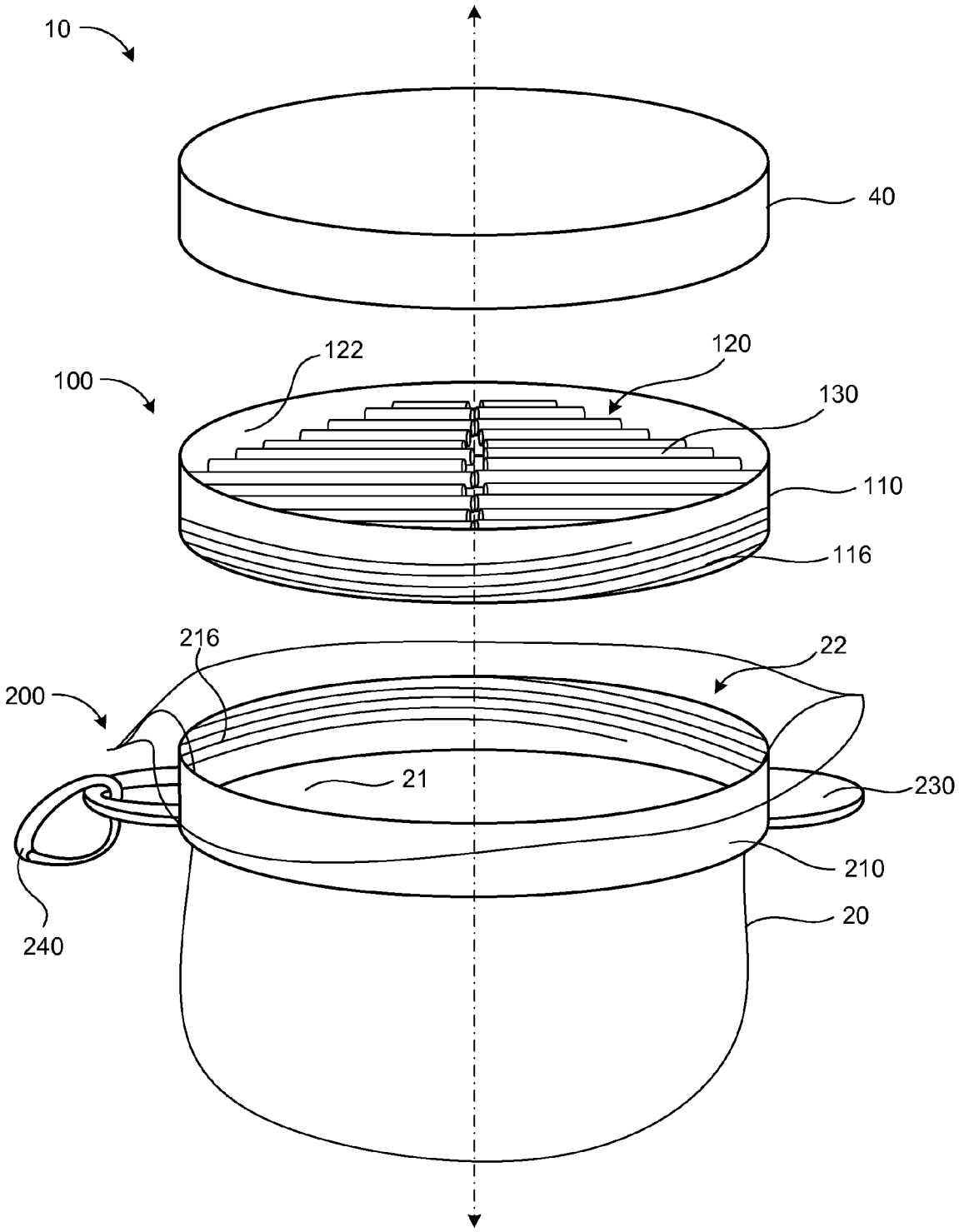
FIG. 8 is a perspective view of a spill inhibiting container system that includes a lid, a spill inhibitor, and a retaining device which threads onto the spill inhibitor for securing a container to the spill inhibitor.

FIG. 8 illustrates an example where the spill inhibitor body 110 defines threads 116 configured to mate with corresponding threads 216 defined by the body 210 of the retaining device 200. The threads 116, 216 are configured to avoid damage to the bag-type container 20 held between the threads 116, 216. The cover 40 may be configured with threads that mate with corresponding threads defined by the retaining device body 210 and/or the container 20. In this configuration, the spill inhibitor 100 can be added to any container 20 with compatible threads, threading onto the container 20, and receiving the cover 40 to seal the container 20. The retaining device body 210 may include one or more handles 230. In some examples, the retaining device body 210 includes a connector 240 (e.g. clip, hoop and loop fastener, etc.) for connecting the retaining device 200 to another object (e.g. a back pack, bag, cart, etc.).

Figure 9:
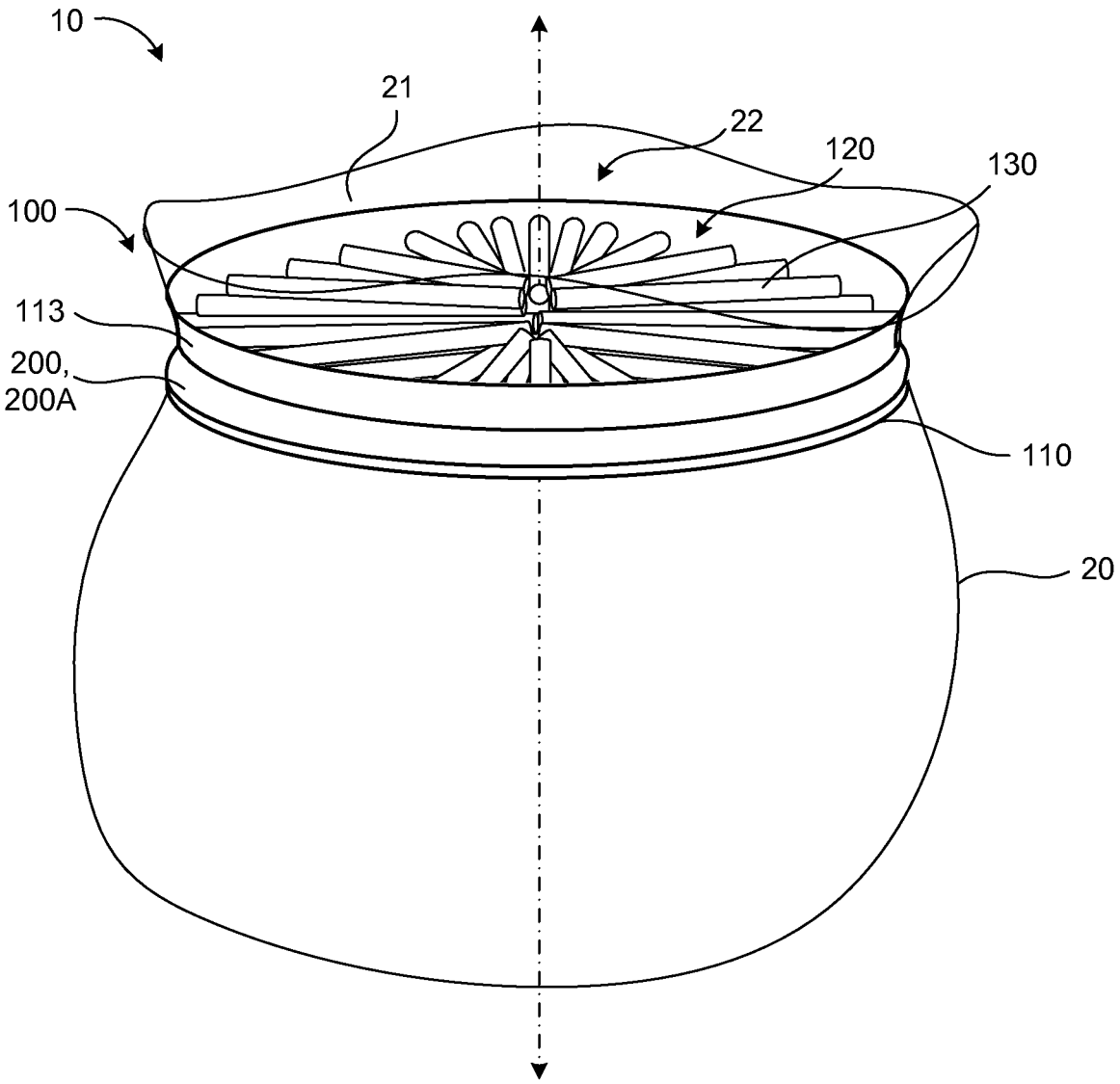
FIG. 9 is a perspective view of a spill inhibitor secured to a bag by an elastic band type retaining device.

In the example illustrated in FIG. 9, the retaining device 200 is a threaded band (e.g. hose clamp) or an elastic band 200A configured to releasably secure at least one wall 21 of the container 20 to the spill inhibitor body 110. In this example, the container 20 is a bag (e.g. made of plastic, cloth, or other material). The spill inhibitor body 110 is configured to be received by the mouth 22 of the container 20. In some examples, the spill inhibitor body 110 defines a retention feature 113 (e.g. groove, recess, curved depression, etc.) configured to receive the band type retaining device 200A.

Figure 10:
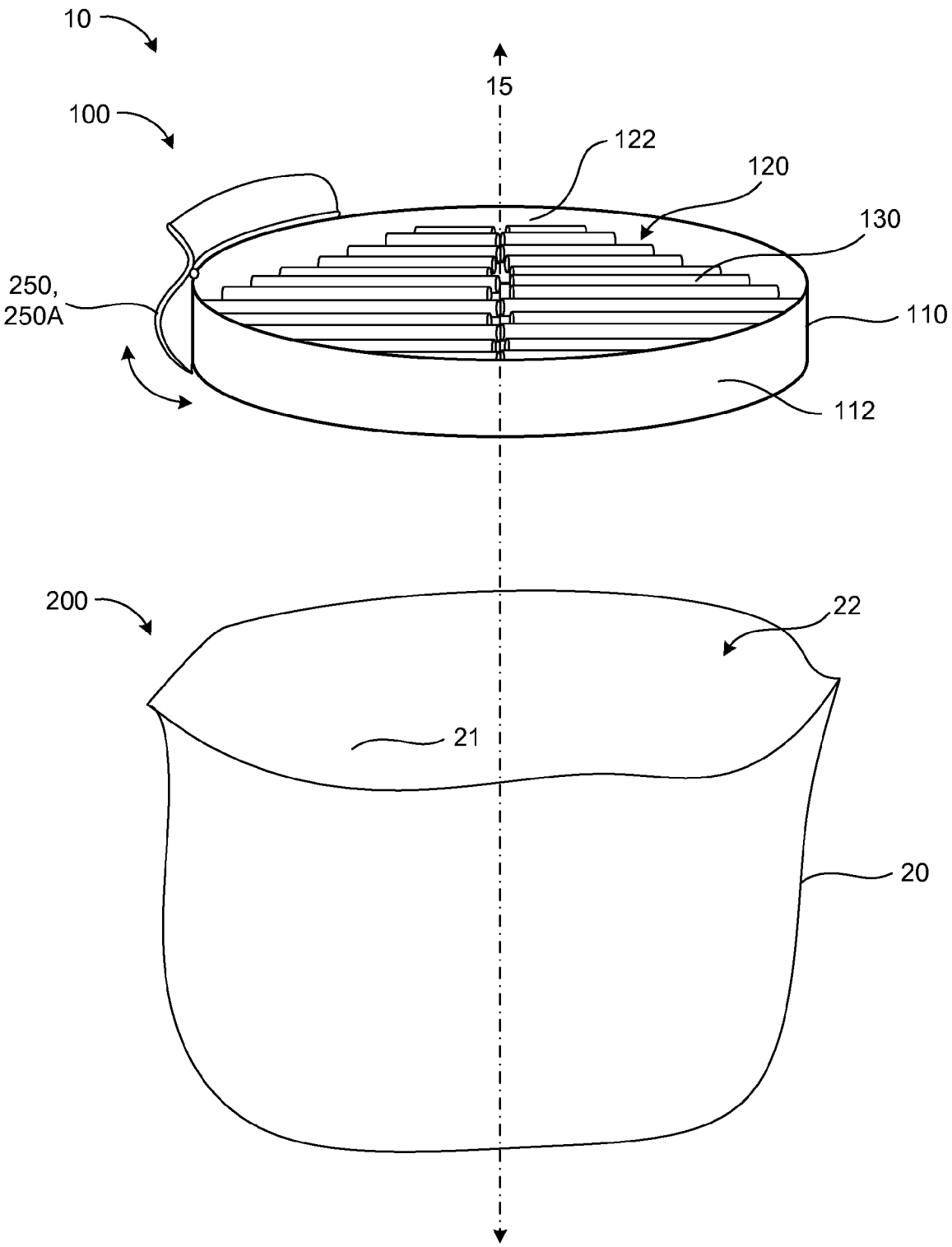
FIG. 10 is a perspective view of a spill inhibiting container system that includes a spill inhibitor having a clip or clamp for releasably securing the spill inhibitor to a container.

In some implementations, the spill inhibiting container system 10 includes at least one fastener system 250 disposed on the spill inhibitor body 110. The fastener system 250 is configured to releasably secure the spill inhibitor 100 to the container 20 (e.g. at the mouth 22 of the container 20). In the example illustrated in FIG. 10, the fastener system 250 includes a clip or clamp 250A configured to releasably secure at least one wall 21 of the container 20 (e.g. cup or bag) to the spill inhibitor body 110. The clip or clamp 250A is shown pivotally attached to the spill inhibitor body 110. However, the clip or clamp 250A may be formed integral with the spill inhibitor body 110. The clip or clamp 250A is biased for engagement with the spill inhibitor body 110 (e.g. by a spring for the pivoting clip or clamp 250A or by elastic deformation of the integral clip or clamp 250A itself) to trap the wall 21 of the container 20 against the spill inhibitor body 110 (e.g. for holding the spill inhibitor 100 in the mouth 22 of the container 20). In some examples, the clip or clamp 250A defines a shape that engages an entire perimeter and/or rim of the spill inhibitor body 110 for sealing or holding the wall 21 of a bag-type container 20 against the spill inhibitor body 110.

Figure 11:
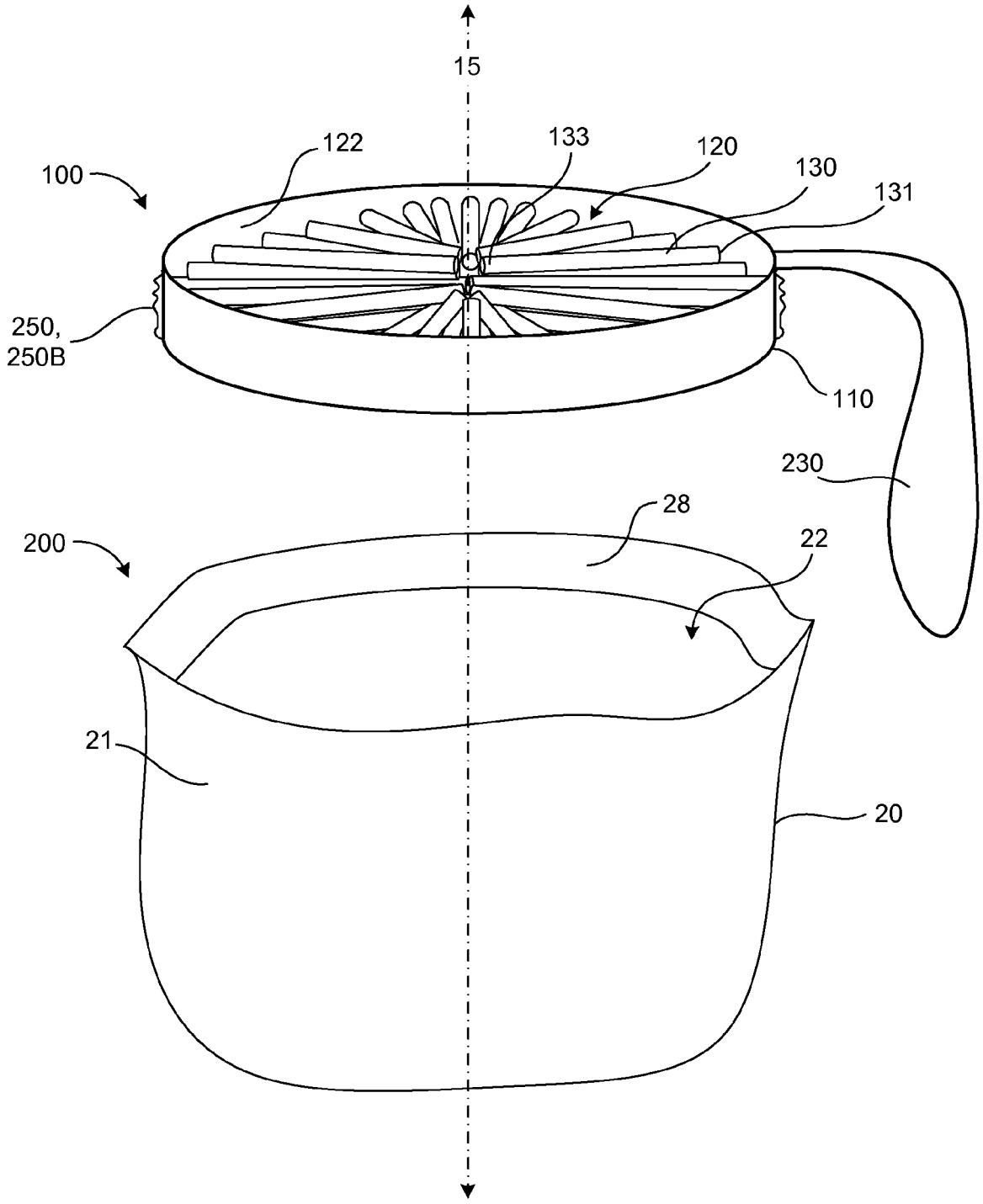
FIG. 11 is a perspective view of a spill inhibiting container system that includes a spill inhibitor releasably securable to a bag-type container by hook and loop fasteners.

In the example illustrated in FIG. 11, the fastener system 250 includes a hook and loop fastener component 250B disposed on the spill inhibitor body 110 for mating with a corresponding hook and loop fastener component 28 of the container 20. The hook and loop fastener component 28, in the example shown, is disposed at the mouth 22 of the container 20 for holding the spill inhibitor 100 in the mouth 22 of the container 20. Other examples of the fastener system 250 include snaps or buttons disposed for releasably fastening the spill inhibitor 100 to the container 20 and a snap-fit, magnet, zipper, strap and buckle, and/or adhesive connections between the spill inhibitor 100 and the container 20. Preferably, the fastener system 250 releasably secures the spill inhibitor 100 in the mouth 22 of the container 20, which may be a plastic cup or bag. In the example shown, the spill inhibitor 100 includes a handle 230 disposed on the spill inhibitor body 110. The handle 230 and/or the spill inhibitor body 110 may define a feature or hole for connecting to other objects (e.g. backpacks, belts, climbing harness, etc.).

For applications using a bag-type container 20 (e.g. plastic bag), a type of seal commonly known as a "zip-lock" may be incorporated into the container 20 for temporarily sealing the mouth 22 of the container 20. The "zip-lock" seal generally includes two strips of hard plastic material, the one strip being a thin plastic "bar" which is pressed into the other strip. The other strip is comprised of two plastic "bars" with a small space between them. When the first strip is pressed into the space between the two plastic "bars" of the second strip, the first and second strip interlock and a water- and air-tight seal is formed. The placement of the first and second strips is completely interchangeable. This type of seal is particularly useful for sealing plastic bags.

Figure 12:
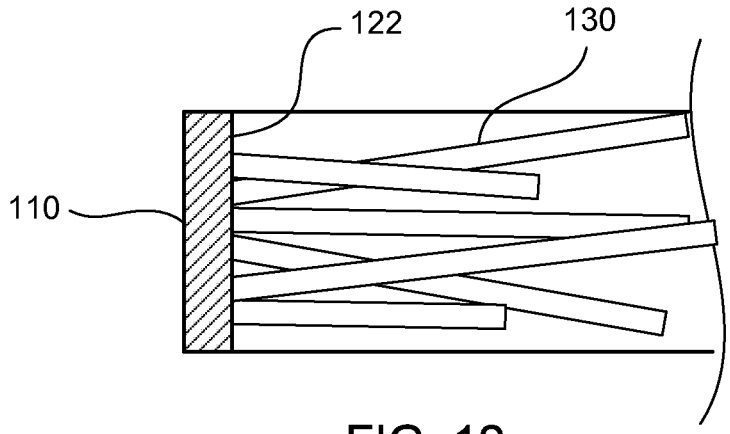
FIG. 12 is a side view of finger projections extending from the spill inhibitor in a random manner.
Figure 13:
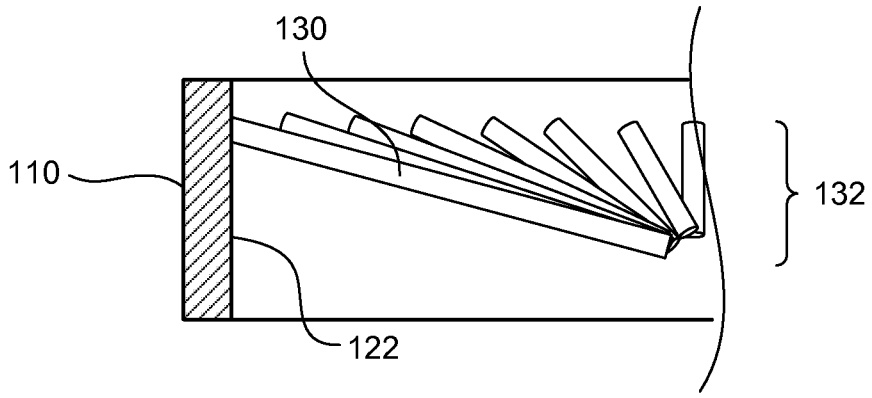
FIG. 13 is a side view of finger projections extending from the spill inhibitor in an ordered manner.
Figure 14:
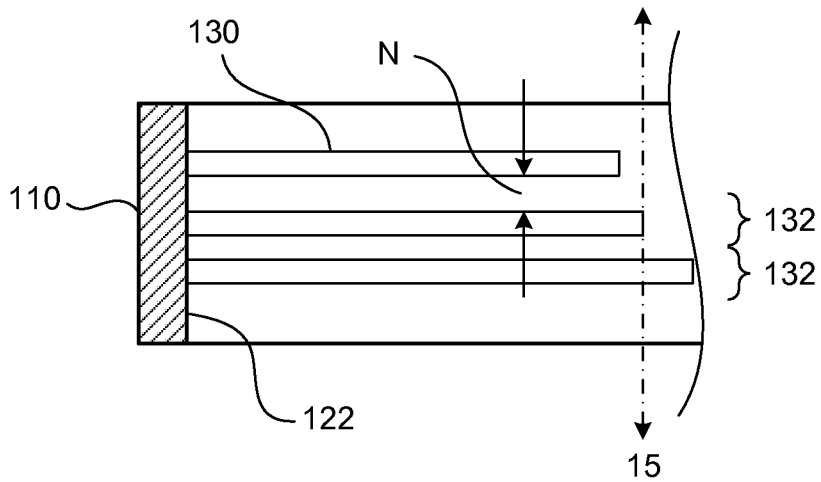
FIG. 14 is a side view of finger projections extending from the spill inhibitor and arranged in two or more layers spaced from each other along a longitudinal axis of the spill inhibitor.
Figure 15:
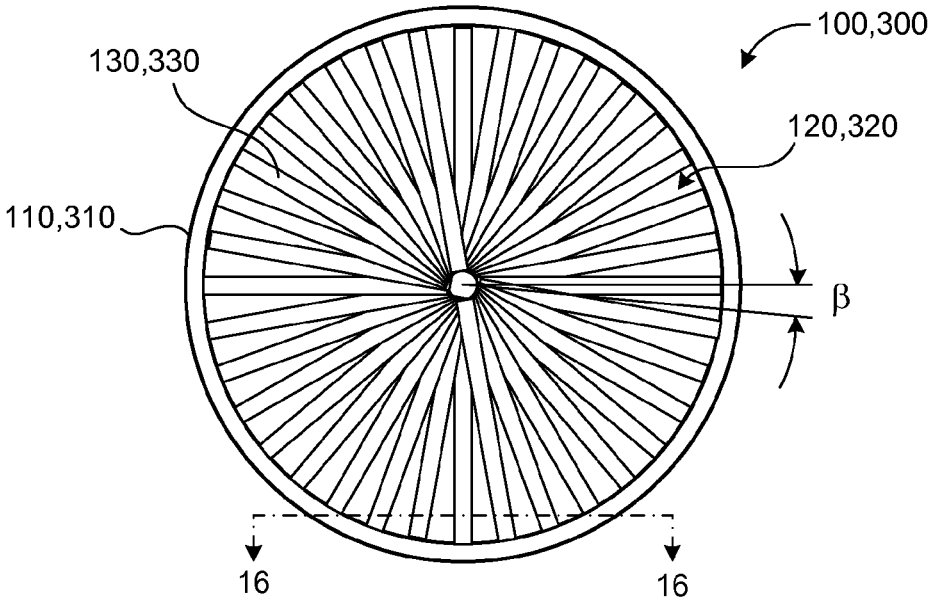
FIG. 15 is a top view of a spill inhibitor having finger projections which extend radially inwardly toward a longitudinal axis defined by the spill inhibitor.
Figure 16:
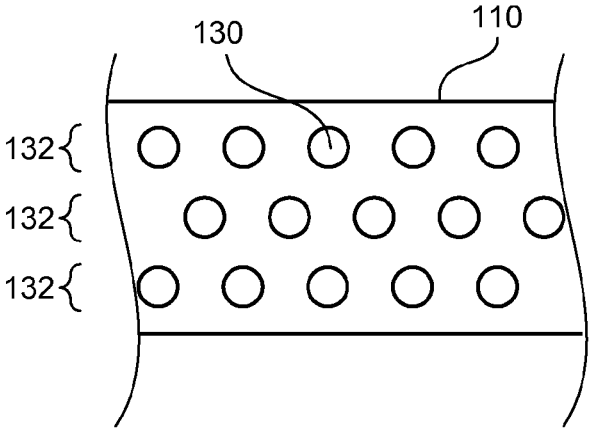
FIG. 16 is a section view along line 16-16 of the spill inhibitor shown in FIG. 15.
Figure 17:
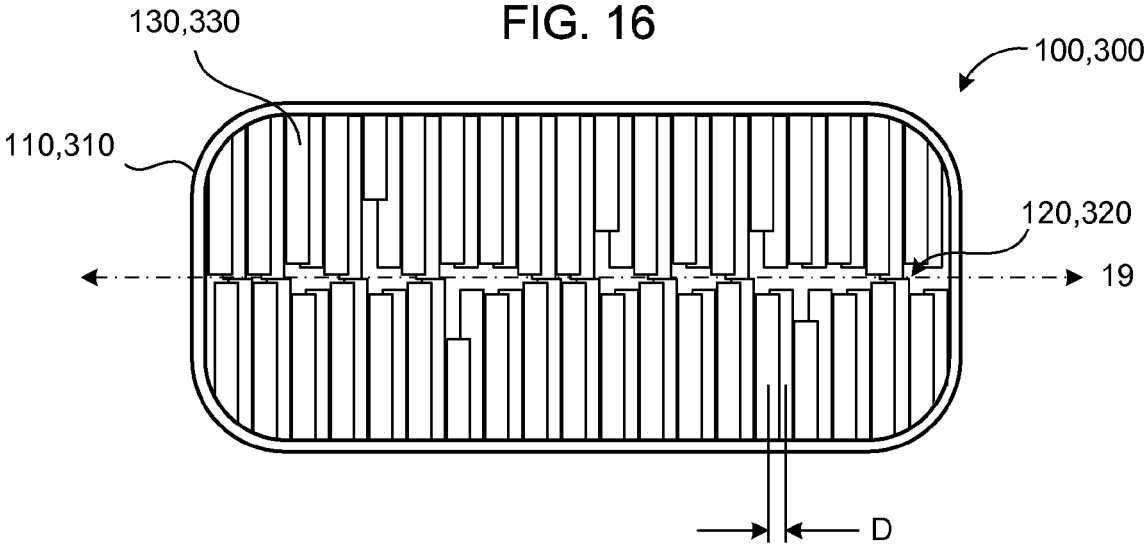
FIG. 17 is a top view of a spill inhibitor having finger projections which extend inwardly toward and substantially normal to a longitudinal plane defined by the spill inhibitor.

The finger projections 130 may extend from the opening surface 122 in an ordered or random fashion. FIG. 12 illustrates an example of the finger projections 130 extending from the opening surface 122 in a random manner. FIG. 13 illustrates an example of the finger projections 130 extending at an angle from the opening surface 122 in an ordered manner, downward and inward. The finger projections 130 are arranged in one layer 132 (e.g. co-planar or symmetrically aligned). FIGS. 14-15 illustrate examples of the finger projections 130 arranged in two or more layers 132 spaced from each other along the longitudinal axis 15. The layers 132 of finger projections 130 may be evenly distributed or spaced at different intervals, N, along the longitudinal axis 15. In some implementations, such as with a circular opening 120 of the spill inhibitor body 110, as shown in FIGS. 15-16, each finger projection layer 132 is offset from an adjacent finger projection layer 132 by a predetermined arc of rotation, β, about the longitudinal axis 15. Similarly, in examples with a polygonal shaped spill inhibitor body 110 defining a transverse axis 19, as shown in FIG. 17, each finger projection layer 132 is offset from an adjacent finger projection layer 132 by a predetermined distance, D, along the transverse axis 19.

Figure 18A:
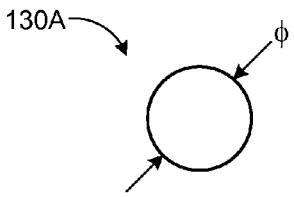
FIG. 18A is an end view of a cylindrical finger projection.
Figure 18B:
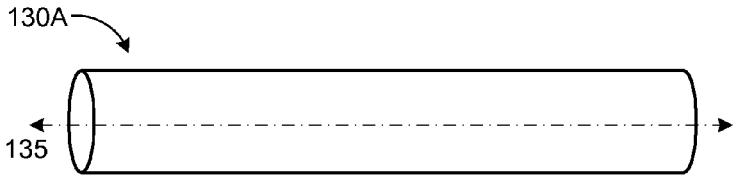
FIG. 18B is a perspective view of the finger projection shown in FIG. 18A.
Figure 19A:
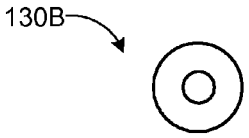
FIG. 19A is an end view of a conical finger projection.
Figure 19B:
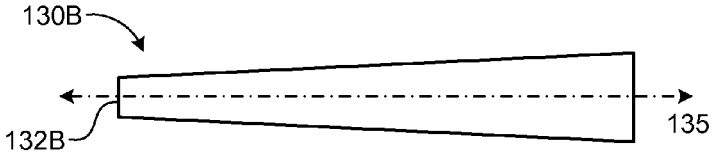
FIG. 19B is a perspective view of the finger projection shown in FIG. 19A.
Figure 20A:
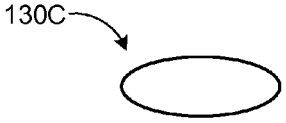
FIG. 20A is an end view of a finger projection having an elliptical cross-section.
Figure 20B:
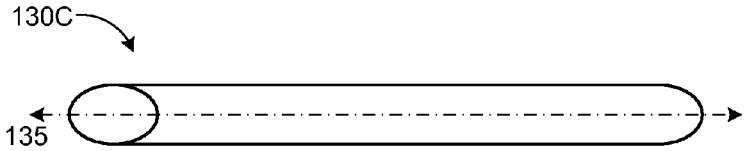
FIG. 20B is a perspective view of the finger projection shown in FIG. 20A.
Figure 21A:
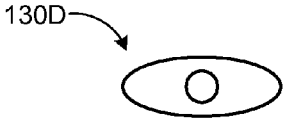
FIG. 21A is an end view of a tapering finger projection having an elliptical cross-section.
Figure 21B:
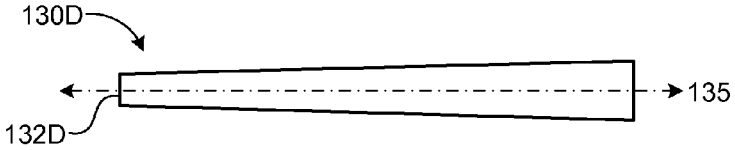
FIG. 21B is a perspective view of the finger projection shown in FIG. 21A.
Figure 22A:
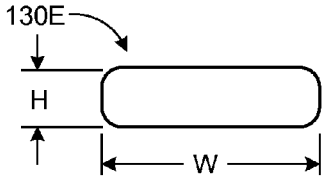
FIG. 22A is an end view of a finger projection having a substantially rectangular cross-section.
Figure 22B:
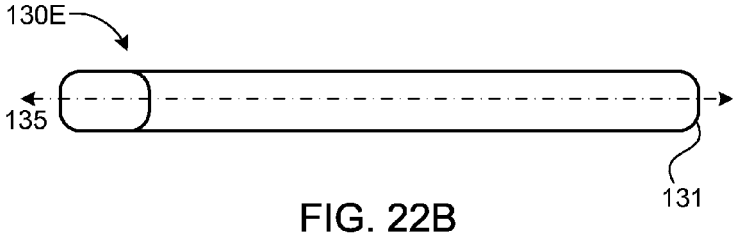
FIG. 22B is a perspective view of the finger projection shown in FIG. 22A.
Figure 23A:
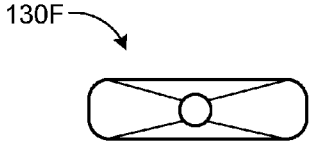
FIG. 23A is an end view of tapering finger projection having a substantially rectangular cross-section.
Figure 23B:
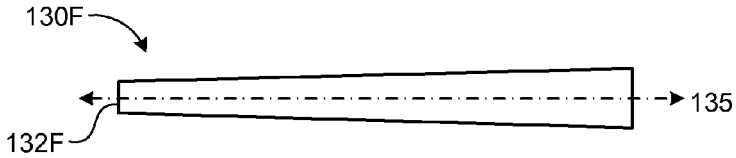
FIG. 23B is a perspective view of the finger projection shown in FIG. 23A.

FIGS. 18A-23B provide examples of finger projections 130 having different geometries. Each finger projection 130 defines a longitudinal axis 135. FIGS. 18A-18B illustrate a finger projection 130A having a substantially cylindrical shape. The finger projection 130A may have a diameter, ϕ, of between about 1 mm and about 40 mm for a snack container or chalk bag application. In the examples illustrated in FIGS. 19A-19B, a finger projection 130B has a substantially frustoconical or conical shape, tapering toward the distal end 132B. FIGS. 20A-20B illustrate a finger projection 130C having a substantially elliptical cross-section and end shape. In some examples, an elliptically cross-sectional shaped finger projection 130D tapers substantial to a point (or blunt end) at its distal end 132D, as shown in FIGS. 21A-21B. FIGS. 22A-22B illustrate a finger projection 130E having a substantially rectangular cross-section and end shape. The finger projection 130E may define other polygonal cross-sectional shapes. The proximal end 131 of the finger projection 130E has an overall height H greater than about 10% of an overall width W measured perpendicular to the height. Each finger projection profile or shape may adhere to this relationship. In some examples, a polygonal cross-sectional shaped finger projection 130F tapers substantial to a point (or blunt end) at its distal end 132F, as shown in FIGS. 23A-23B. The finger projections 130, in some examples, have a polyhedron shape. A polyhedron is a geometric object with flat faces and straight edges. Examples of polyhedrons include a tetrahedron (4 sides), a pentahedron (5 sides), a hexahedron (6 sides), a heptahedron (7 sides), a triacontahedron (30 sides), and more. The polyhedrons may be further modified by rounding one or more edges. Each finger projection 130 may have a different shape and a number of different cross-sectional shapes at different locations along the finger projection 130.

In some implementations, the spill inhibiting container system 10 includes the spill inhibitor 100 integral with the container 20 for controlling passage of an item 30 through the mouth 22 and into or out of the container receptacle 27. This implementation is illustrated in the example shown in FIG. 24, where the spill inhibiting container system 10 is a container 300 having a container body 310 that defines a receptacle 320 for holding at least one item 30. The receptacle 320 has upper and low portions 321 and 323, respectively, where the upper portion 321 of the receptacle 330 defines a mouth 325 and a plurality of compliant finger projections 330 extending from a surface 322 of the upper portion 321 of the receptacle 320. The finger projections 330 impede at least one item 30 from exiting the mouth 325. The spill inhibiting container system 10 may be made of a soft durable material that allows complete inversion (e.g. turned inside out) of the container 20 portion.

Figure 24:
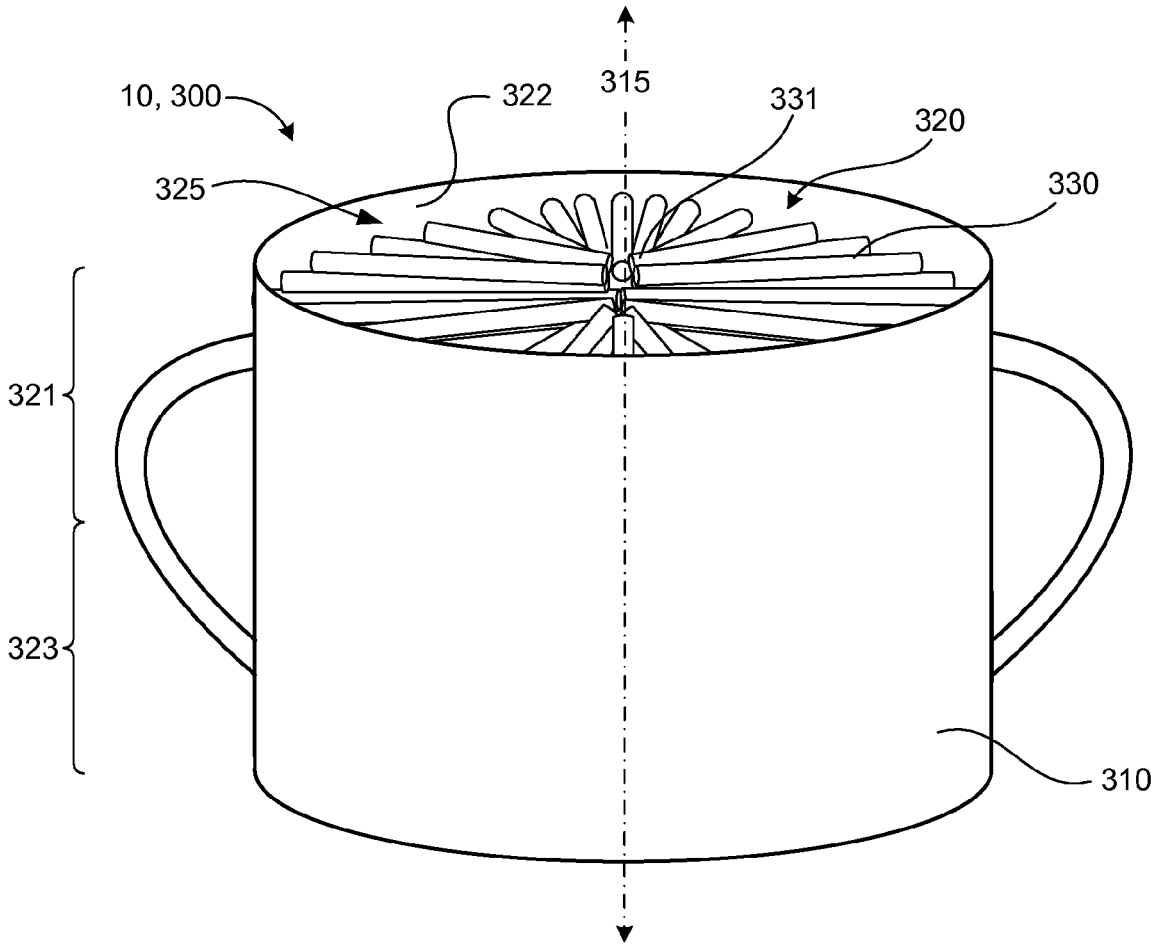
FIG. 24 is a perspective view of a container with handles and a plurality of finger projections extending radially inward into the mouth of the container.

In some implementations, as shown in FIG. 24, the finger projections 330 extend from the receptacle surface 322 radially inwardly toward a longitudinal axis 315 defined by the container body 310, such that the finger projections 330 substantially provide a closure of the mouth 325. In some examples, the distal ends 331 of the finger projections 330 are positioned substantially in proximity with the longitudinal axis 315, while in other examples the distal ends 331 of the finger projections 330 are positioned in other arrangements, such as random.

Figure 25:
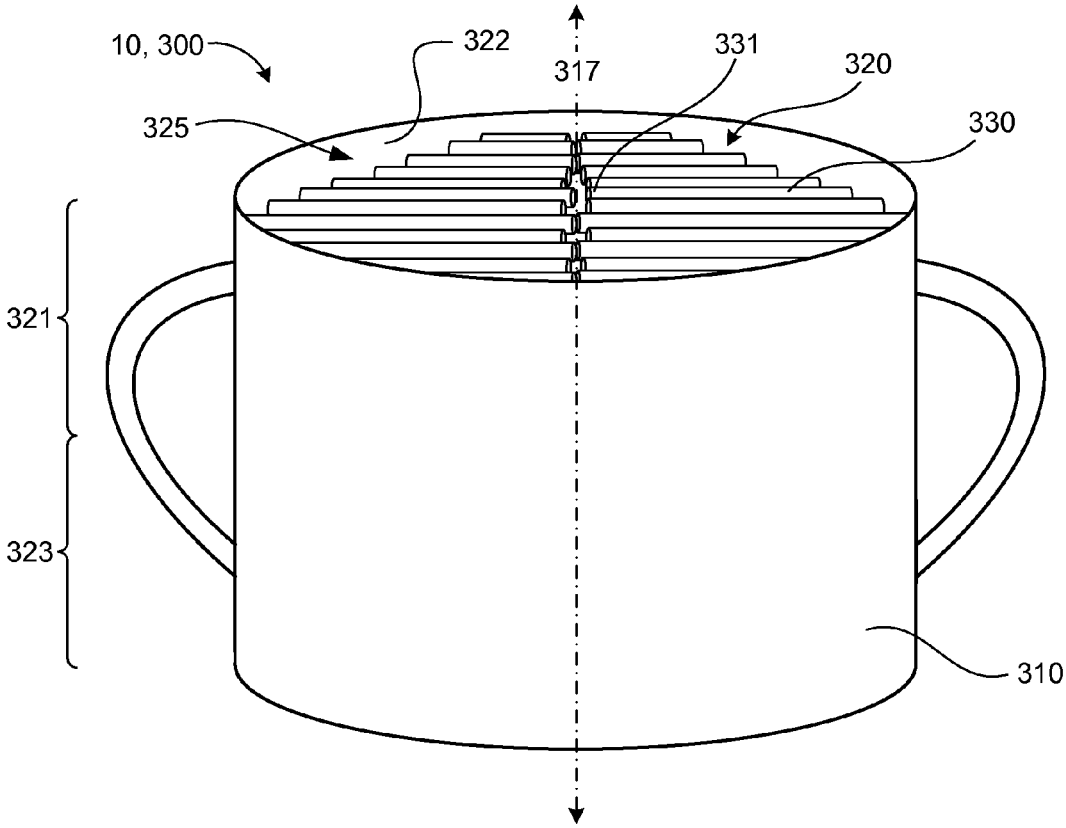
FIG. 25 is a perspective view of a container with handles and a plurality of finger projections extending inward into the mouth of the container and substantially normal to a longitudinal plane defined by the container.
Figure 26:
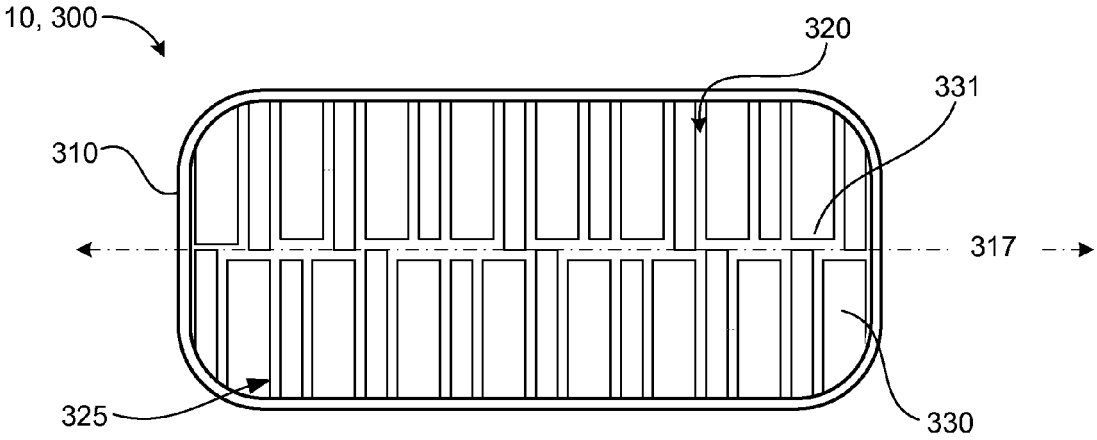
FIG. 26 is a top view of a container with a substantially rectangular mouth and a plurality of finger projections extending inward into the mouth of the container and substantially normal to a longitudinal plane defined by the container.

In some implementations, as shown in FIGS. 25-26, the finger projections 330 extend toward and perpendicular to a longitudinal plane 317 defined by the container body 310, such that the finger projections 330 substantially provide a closure of the mouth 325. The distal ends 331 of the finger projections 330 are positioned in proximity with the longitudinal plane 317. In some examples, the finger projections 330 are substantially normal to the longitudinal plane 317. FIG. 26 illustrates an example where the finger projections 330 have different geometries (e.g. rectangular profiles and circle profiles) disposed along the receptacle surface 322.

Figure 27:
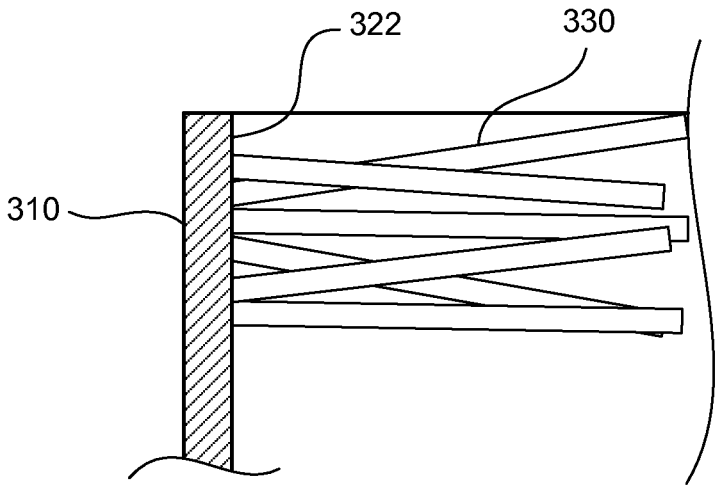
FIG. 27 is a side view of finger projections extending from the container in a random manner.
Figure 28:
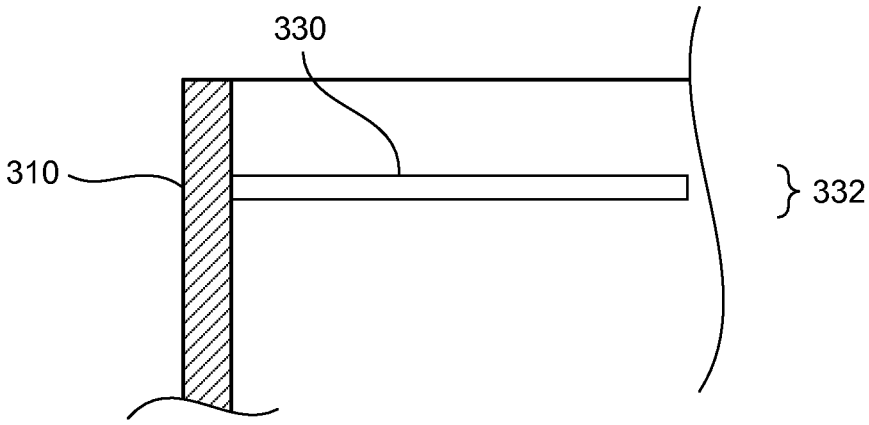
FIG. 28 is a side view of finger projections extending from the container in an ordered manner.
Figure 29:
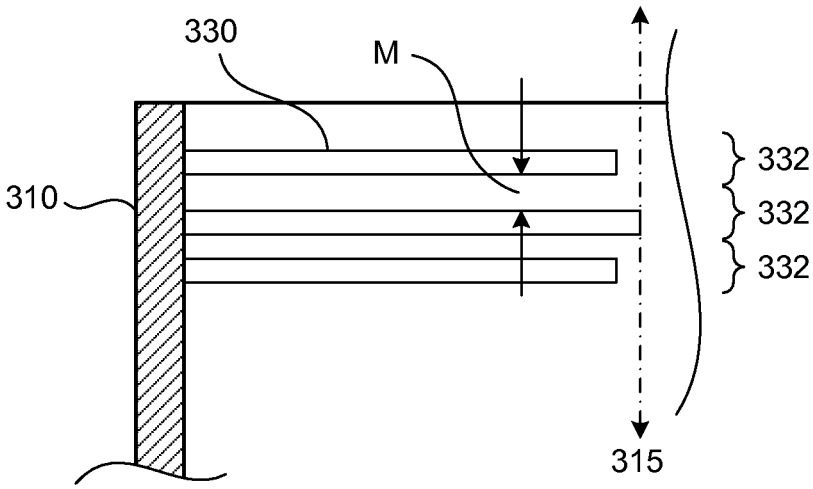
FIG. 29 is a side view of finger projections extending from the container and arranged in two or more layers spaced from each other along a longitudinal axis of the container.

The finger projections 330 may be arranged in all the same manners previously described with reference to the spill inhibitor 100 examples in FIGS. 12-17, such that the spill inhibitor body 110 is considered integral with the container body 310 and the opening surface 122 is part of the receptacle surface 322. FIG. 27 illustrates an example of the finger projections 330 extending from the receptacle surface 322 in a random manner. FIG. 28 illustrates an example of the finger projections 330 extending from the receptacle surface 122 in an ordered manner with the finger projections 330 arranged in one layer 332 (e.g. co-planar). FIG. 29 illustrates an example of the finger projections 330 arranged in two or more layers 332 spaced from each other along the longitudinal axis 315. The layers 332 of finger projections 330 may be evenly distributed or spaced at different intervals, M, along the longitudinal axis 315. In some implementations, such as with a circular receptacle 320, each finger projection layer 132 is offset from an adjacent finger projection layer 132 by a predetermined arc of rotation, β, about the longitudinal axis 15, 315, as shown and previously described in FIGS. 15-16. Similarly, in examples with polygonal shaped receptacles 320 defining a transverse axis 19, each finger projection layer 132 is offset from an adjacent finger projection layer 132 by a predetermined distance, D, along the transverse axis 19, as shown and previously described in FIG. 17.

Figure 30:
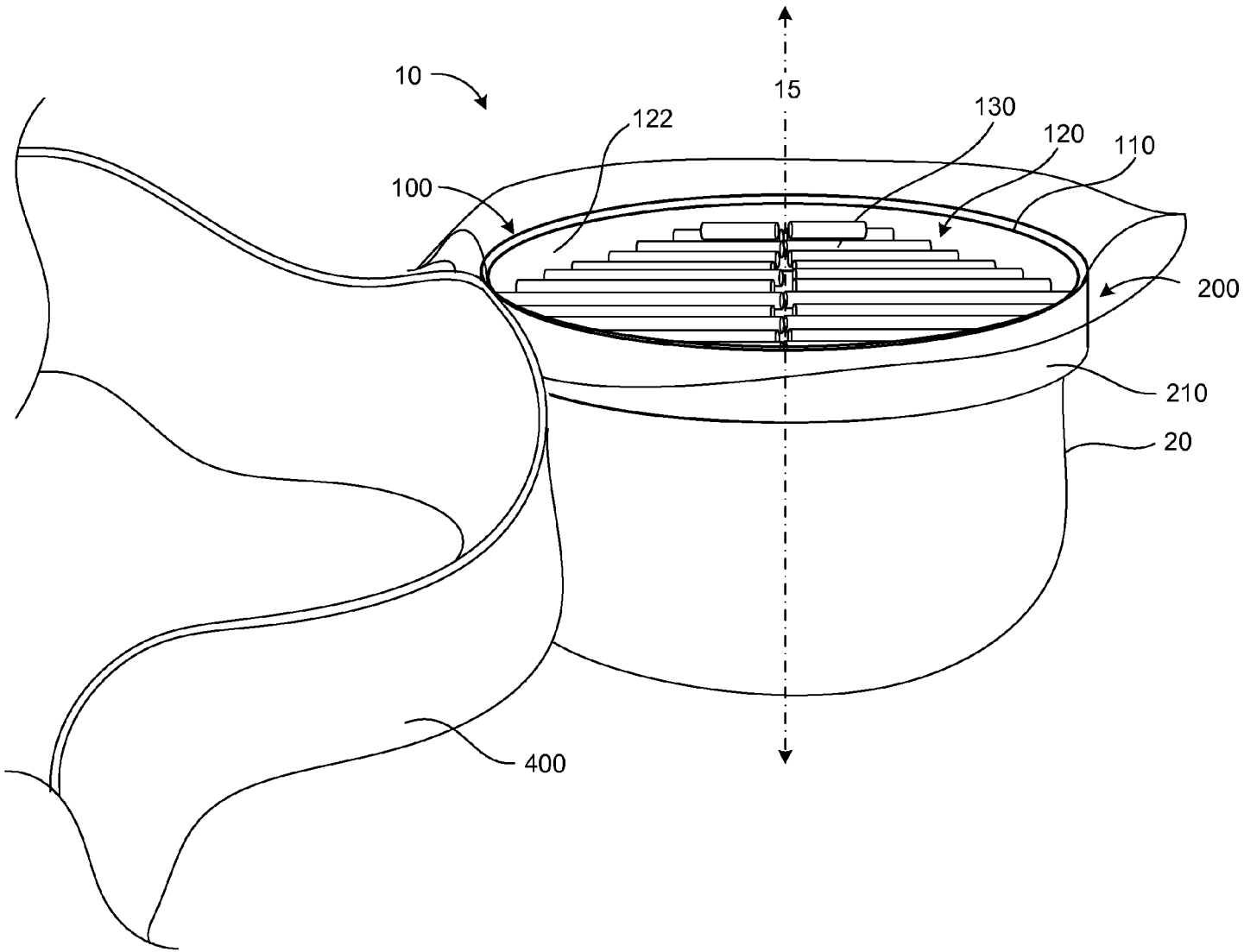
FIG. 30 is a perspective view of a spill inhibiting container system associated with a belt.
Figure 31:
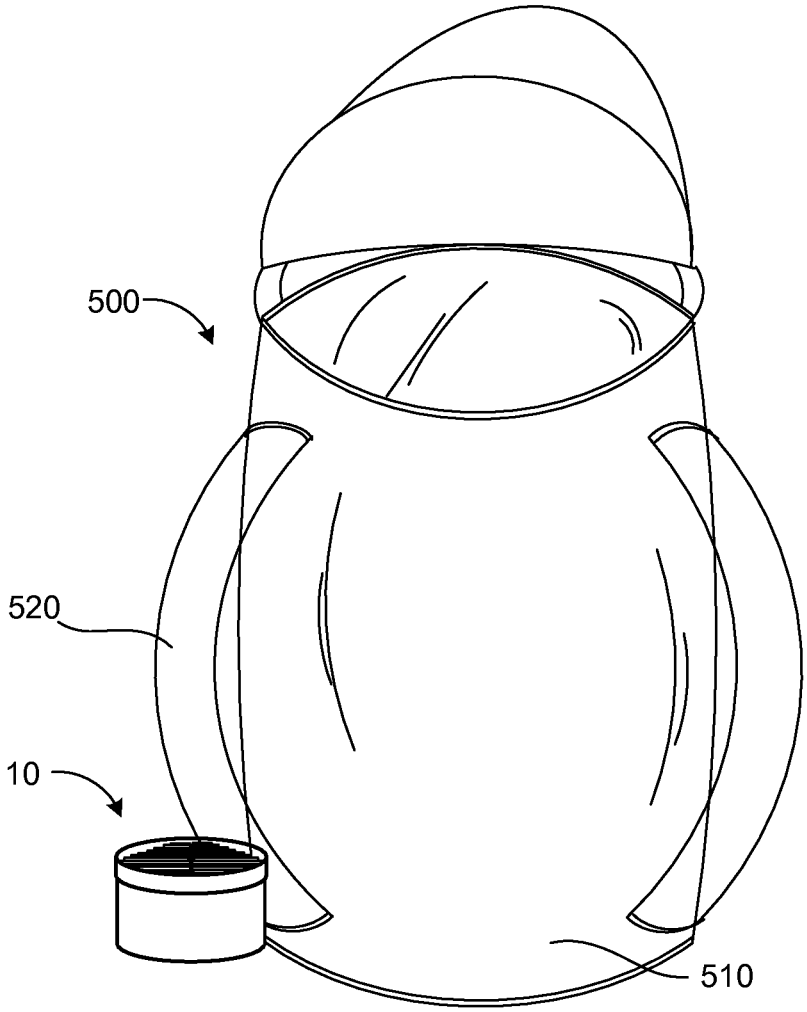
FIG. 31 is a perspective view of a spill inhibiting container system associated with a back pack.
Figure 32:
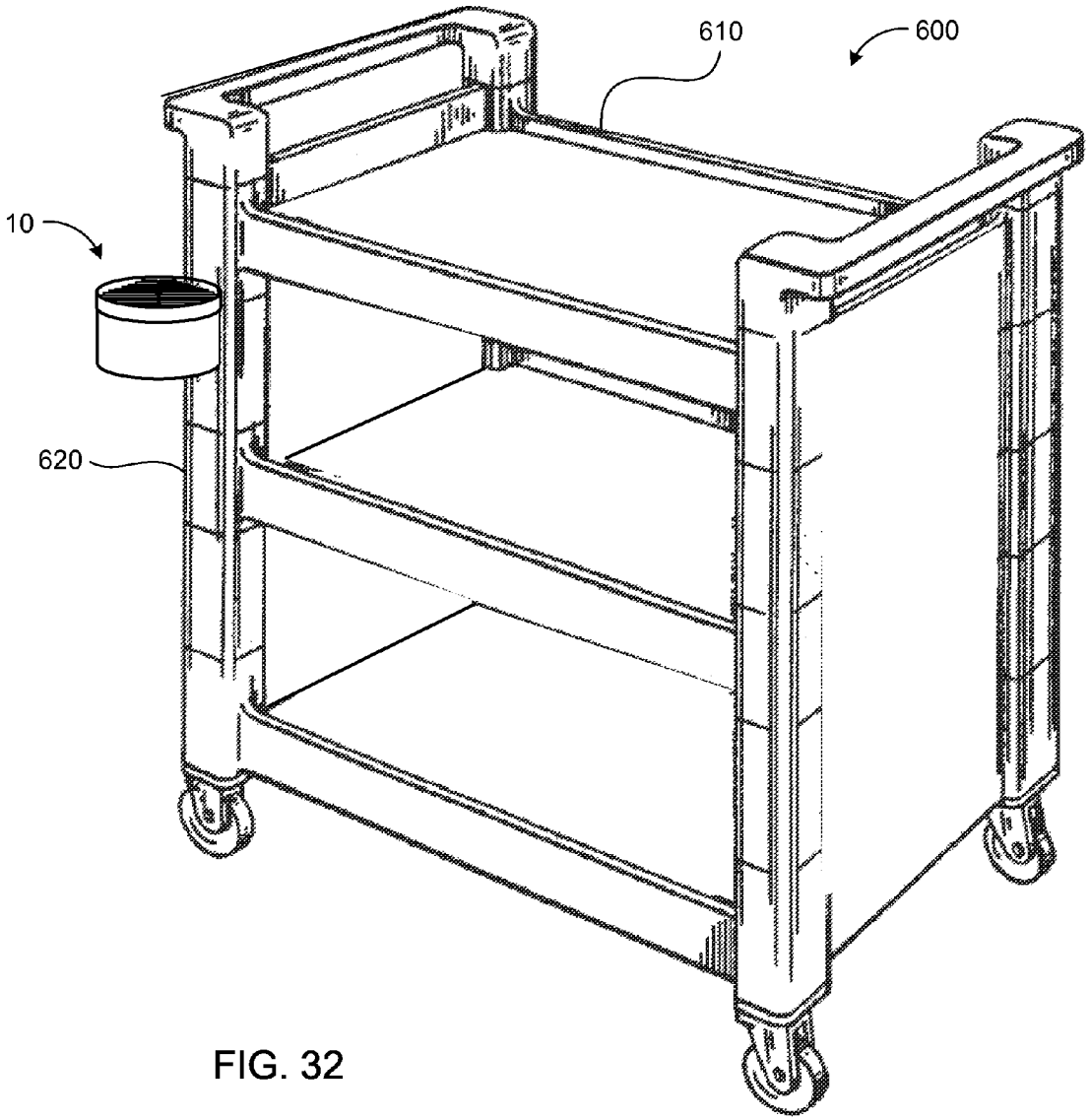
FIG. 32 is a perspective view of a spill inhibiting container system associated with a utility cart.
Figure 33:
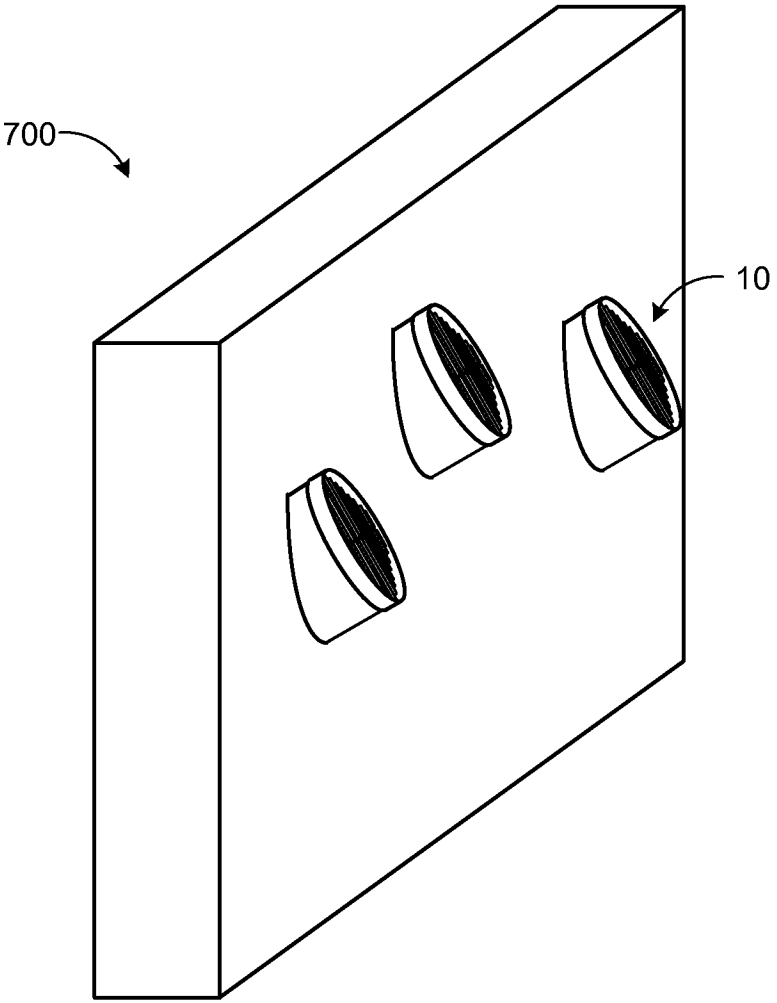
FIG. 33 is a perspective view of a spill inhibiting container system associated with a utility stand.

The spill inhibiting container system 10 may be attached to or made integral with a race belt, back pack, bike, wheel chair, stroller, child car seat, high-chair, utility cart, workbench, cabinet, and power tool among other applications. FIG. 30 illustrates an example of the spill inhibiting container system 10 secured to a belt 400. This configuration may be used as a chalk bag for mountain climbing or as a race belt (e.g. for running and/or triathlons). FIG. 31 illustrates an example of the spill inhibiting container system 10 secured or releasably attached to a back pack 500. The spill inhibiting container system 10 is shown secured to a strap 520 of the back pack 500, but may be secured to any other part of the back pack 500, including a main body 510 of the back pack 500. FIG. 32 illustrates an example of the spill inhibiting container system 10 secured or releasably attached to a utility cart 600. The spill inhibiting container system 10 is shown secured to a vertical member 620 of the utility cart 600, but may be secured to any other part of the utility cart 600, including a main body 610 of the utility cart 600. The spill inhibiting container system 10 may be attached or received in a utility stand 700 designed to accommodate one or more spill inhibiting container systems 10. FIG. 33 illustrates an example of more than one spill inhibiting container systems 10 secured or releasably attached to a utility stand 700. The spill inhibiting container system 10 is shown secured to the utility stand 700 by interference fit, but may be secured by a fastener or other releasable means.

A number of implementations have been described. Nevertheless, it will be understood that various modifications may be made without departing from the spirit and scope of the disclosure. Accordingly, other implementations are within the scope of the following claims.

What is claimed is:

1. A spill inhibitor for a container, the spill inhibitor comprising:

a spill inhibitor body defining an opening;

a plurality of compliant finger projections extending from the spill inhibitor body and arranged to substantially fully cover the opening for impeding movement of an item through the opening; and a fastener disposed on the spill inhibitor body and configured to releasably fasten the spill inhibitor to a container;

wherein at least one finger projection has a cross-sectional width substantially similar to a cross-sectional height;

wherein at least one finger projection has a first end attached to the spill inhibitor body and extends to an unattached distal, second end; and wherein at least one finger projection has a durometer of between about 30 Shore A and about 60 Shore A.

2. The spill inhibitor of claim 1, wherein the spill inhibitor body is configured to be received in the mouth of the container.

3. The spill inhibitor of claim 2, wherein the spill inhibitor body defines a lip configured to be received against a rim of the mouth of the container and hold the spill inhibitor body at the mouth of the container.

4. A spill inhibitor for a container, the spill inhibitor comprising:

a spill inhibitor body configured to be releasably secured to the container, the spill inhibitor body defining an opening; and a plurality of compliant finger projections extending from the spill inhibitor body and arranged to substantially fully cover the opening for impeding movement of an item through the opening;

wherein at least one finger projection has a cross-sectional width substantially similar to a cross-sectional height;

wherein at least one finger projection has a first end attached to the spill inhibitor body and extends to an unattached distal, second end; and wherein at least one finger projection has a durometer of between about 30 Shore A and about 60 Shore A;

wherein the spill inhibitor body defines threads configured to mate with corresponding threads defined by the container.

5. The spill inhibitor of claim 1, wherein the fastener defines an engagement portion configured to engage and couple the spill inhibitor body to the mouth of the container.

6. The spill inhibitor of claim 1, wherein the fastener releasably fastens the spill inhibitor to the opening of the container.

7. The spill inhibitor of claim 6, wherein the fastener system comprises a clamp.

8. The spill inhibitor of claim 6, wherein the fastener system comprises a hook and loop fastener system.

9. The spill inhibitor of claim 1, wherein each finger projection has a proximal end joined to the spill inhibitor body and a free distal end, the proximal end of at least one finger projection having an overall height greater than about 10% of an overall width measured perpendicular to the height.

10. The spill inhibitor of claim 1, wherein the finger projections extend radially inwardly toward a longitudinal axis defined by the spill inhibitor body, such that the finger projections substantially provide a closure of the opening.

11. The spill inhibitor of claim 1, wherein the finger projections are arranged substantially co-planar in at least two layers spaced from each other along a longitudinal axis defined by the spill inhibitor body.

12. The spill inhibitor of claim 11, wherein each finger projection layer is offset from an adjacent finger projection layer by a predetermined arc of rotation about the longitudinal axis.

13. A spill inhibitor for a container, the spill inhibitor comprising:

a spill inhibitor body defining an opening;

a plurality of compliant finger projections extending from the spill inhibitor body and arranged to substantially fully cover the opening for impeding movement of an item through the opening; and a fastener disposed on the spill inhibitor body and configured to releasably fasten the spill inhibitor to a container;

wherein at least one finger projection has a cross-sectional width substantially similar to a cross-sectional height;

wherein at least one finger projection has a first end attached to the spill inhibitor body and extends to an unattached distal, second end; and wherein the finger projections extend from the spill inhibitor body as one integrally molded piece.

14. The spill inhibitor of claim 1, wherein at least one of the finger projections defines a substantially cylindrical shape.

15. The spill inhibitor of claim 1, wherein at least one of the finger projections defines a substantially polyhedron shape.

16. The container of claim 1, wherein at least one of the finger projections tapers in cross-sectional shape from a proximal end joined to the spill inhibitor body to a free distal end.

17. A spill inhibitor system for a bag, the spill inhibitor system comprising:

a spill inhibitor comprising:

a spill inhibitor body defining an opening therethrough; and a plurality of compliant finger projections extending from the spill inhibitor body and arranged to substantially fully cover the opening for impeding movement of an item through the opening; and a retaining device configured to releasably secure the spill inhibitor to at least a portion of the bag;

wherein at least one finger projection has a cross-sectional width substantially similar to a cross-sectional height;

wherein at least one finger projection has a first end attached to the spill inhibitor body and extends to an unattached distal, second end disposed radially inward of a surface of the opening; and wherein at least one finger projection has a durometer of between about 30 Shore A and about 60 Shore A.

18. The spill inhibitor system of claim 17, wherein the retaining device defines threads configured to mate with corresponding threads defined by the spill inhibitor body, at least a portion of the bag being held between the spill inhibitor body and the mating retaining device.

19. The spill inhibitor system of claim 17, wherein the retaining device comprises a band sized to fit around the perimeter of the spill inhibitor body, at least a portion of the bag being held between the spill inhibitor body and the band received over the spill inhibitor body.

20. The spill inhibitor system of claim 17, wherein the retaining device is magnetically secured to the spill inhibitor body with at least a portion of the bag being held therebetween.

21. The spill inhibitor system of claim 17, wherein the retaining device defines an engagement portion configured to engage and couple the retaining device to the spill inhibitor body with at least a portion of the bag being held therebetween.

22. The spill inhibitor system of claim 17, wherein each finger projection has a proximal end joined to the spill inhibitor body and a free distal end, the proximal end of at least one finger projection having an overall height greater than about 10% of an overall width measured perpendicular to the height.

23. The spill inhibitor system of claim 17, further comprising at least one fastener system disposed on the spill inhibitor body and configured to releasably secure the spill inhibitor to the container.

24. The spill inhibitor system of claim 23, wherein the fastener system comprises a clamp.

25. The spill inhibitor system of claim 23, wherein the fastener system comprises a hook and loop fastener system.

26. The spill inhibitor system of claim 17, wherein the finger projections extend radially inwardly toward a longitudinal axis defined by the spill inhibitor body, such that the finger projections substantially provide a closure of the opening.

27. The spill inhibitor system of claim 17, wherein the finger projections extend inwardly toward and substantially normal to a longitudinal plane defined by the spill inhibitor body, such that the finger projections substantially provide a closure of the opening.

28. The spill inhibitor system of claim 17, wherein the finger projections are arranged substantially co-planar in at least two layers spaced from each other along a longitudinal axis defined by the spill inhibitor body.

29. The spill inhibitor system of claim 28, wherein each finger projection layer is offset from an adjacent finger projection layer by a predetermined arc of rotation about the longitudinal axis.

30. The spill inhibitor system of claim 17, wherein at least one of the finger projections defines a substantially cylindrical shape.

31. The spill inhibitor system of claim 17, wherein at least one of the finger projections defines a substantially polyhedron shape.

32. The container system of claim 17, wherein at least one of the finger projections tapers in cross-sectional shape from a proximal end joined to the spill inhibitor body to a free distal end.

33. A spill inhibiting container comprising:

a container body defining a receptacle having an opening; and a plurality of compliant finger projections extending from the container body, the finger projections arranged to substantially fully cover the opening for impeding movement of an item through the opening;

wherein at least one finger projection has a cross-sectional width substantially similar to a cross-sectional height;

wherein at least one finger projection has a first end attached to the spill inhibitor body and extends to an unattached distal, second end; and wherein at least one finger projection has a durometer of between about 30 Shore A and about 60 Shore A.

34. The spill inhibiting container of claim 33, wherein each finger projection has a proximal end joined to the container body and a free distal end, the proximal end of at least one finger projection having an overall height greater than about 10% of an overall width measured perpendicular to the height.

35. The spill inhibiting container of claim 33, wherein the finger projections extend from the receptacle surface radially inwardly toward a longitudinal axis defined by the container body, such that the finger projections substantially provide a closure of the opening.

36. The spill inhibiting container of claim 33, wherein the finger projections extend from the container body inwardly toward and substantially normal to a single longitudinal plane defined by the container body, such that the finger projections substantially provide a closure of the opening.

37. The spill inhibiting container of claim 33, wherein the finger projections are arranged substantially co-planar in at least two layers spaced from each other along a longitudinal axis defined by the container body.

38. The spill inhibiting container of claim 37, wherein each finger projection layer is offset from an adjacent finger projection layer by a predetermined arc of rotation about the longitudinal axis.

39. The spill inhibiting container of claim 33, wherein at least one of the finger projections defines a substantially cylindrical shape.

40. The spill inhibiting container of claim 33, wherein at least one of the finger projections defines a substantially polyhedron shape.

41. The spill inhibiting container of claim 33, wherein at least one of the finger projections tapers in cross-sectional shape from a proximal end joined to the container body to a free distal end.

42. The spill inhibiting container of claim 33, further comprising a cover removably secured to the container body, covering the mouth of the container.

43. The spill inhibitor of claim 4, wherein the spill inhibitor body is configured to be received in the mouth of the container.

44. The spill inhibitor of claim 43, wherein the spill inhibitor body defines a lip configured to be received against a rim of the mouth of the container and hold the spill inhibitor body at the mouth of the container.

45. The spill inhibitor of claim 4, wherein the finger projections extend radially inwardly toward a longitudinal axis defined by the spill inhibitor body, such that the finger projections substantially provide a closure of the opening.

46. The spill inhibitor of claim 4, wherein the finger projections extend inwardly toward and substantially normal to a single longitudinal plane defined by the spill inhibitor body, such that the finger projections substantially provide a closure of the opening.

47. The spill inhibitor of claim 4, wherein the finger projections are arranged substantially co-planar in at least two layers spaced from each other along a longitudinal axis defined by the spill inhibitor body.

48. The spill inhibitor of claim 47, wherein each finger projection layer is offset from an adjacent finger projection layer by a predetermined arc of rotation about the longitudinal axis.

49. The spill inhibitor of claim 4, wherein the finger projections extend from a surface of the opening.

50. The spill inhibitor of claim 4, wherein at least one of the finger projections defines a substantially cylindrical shape.

51. The spill inhibitor of claim 4, wherein at least one of the finger projections defines a substantially polyhedron shape.

* * * * *